US009047773B2

(12) United States Patent
Chen et al.

(10) Patent No.: US 9,047,773 B2
(45) Date of Patent: Jun. 2, 2015

(54) EXCEPTIONAL ROAD-CONDITION WARNING DEVICE, SYSTEM AND METHOD FOR A VEHICLE

(75) Inventors: Syuan-Yi Chen, Changhua County (TW); Chih-Tang Chang, Taipei (TW); Yu-Hui Lin, Miaoli County (TW); Ying-Chieh Lei, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 361 days.

(21) Appl. No.: 13/465,035

(22) Filed: May 7, 2012

(65) Prior Publication Data

US 2013/0154854 A1 Jun. 20, 2013

(30) Foreign Application Priority Data

Dec. 14, 2011 (TW) ..... 100146222 A

(51) Int. Cl.
*G08G 1/09* (2006.01)
*G08G 1/0967* (2006.01)
*G08G 1/16* (2006.01)

(52) U.S. Cl.
CPC .... *G08G 1/096741* (2013.01); *G08G 1/096775* (2013.01); *G08G 1/164* (2013.01)

(58) Field of Classification Search
CPC ..... G08G 1/09
USPC ..... 340/905, 995.13, 436; 701/414, 451
See application file for complete search history.

(56) References Cited

U.S. PATENT DOCUMENTS 6,862,524 B1 3/2005 Nagda et al.
7,057,532 B2 6/2006 Shafir et al.
7,679,499 B2 3/2010 Yamada (Continued)

FOREIGN PATENT DOCUMENTS

CN 101083018 12/2007
CN 101114404 1/2008

(Continued)

OTHER PUBLICATIONS

Tu et al, "Forwards: A Map-Free Intersection Collision-Warning System for All Road Patterns", IEEE Transactions on Vehicular Technology 59(7), Sep. 2010, pp. 3233-3248.

(Continued)

*Primary Examiner* — Brent Swarthout
(74) *Attorney, Agent, or Firm* — Jianq Chyun IP Office

(57) ABSTRACT

An exceptional road-condition warning device, system and method for a vehicle are provided. The system includes an information processing device and a display device. The display device provides real-time and advance warning information to a driver of the vehicle. The system may notice the driver and passenger in advance to respond to an exceptional road condition before the vehicle approaches the occurring place of the road condition through a back-end cooperative self-learning mechanism. The back-end cooperative self-learning mechanism may collect the exceptional road conditions from different vehicles and update the database automatically to maintain the accuracy. The back-end cooperative self-learning mechanism further shares the information stored in the database with the databases installed in the vehicles by a bidirectional communication manner to update the information inside the database of the vehicles for the information processing device.

27 Claims, 18 Drawing Sheets

(56) References Cited

U.S. PATENT DOCUMENTS

| | | | | |
|---|---|---|---|---|
| 2006/0015254 | A1* | 1/2006 | Smith | 702/3 |
| 2009/0259349 | A1* | 10/2009 | Golenski | 701/2 |
| 2009/0318121 | A1* | 12/2009 | Marumoto | 455/414.1 |
| 2010/0207787 | A1 | 8/2010 | Catten et al. | |
| 2011/0267205 | A1* | 11/2011 | McClellan et al. | 340/936 |
| 2012/0092187 | A1* | 4/2012 | Scholl et al. | 340/905 |

FOREIGN PATENT DOCUMENTS

| | | |
|---|---|---|
| CN | 101278325 | 10/2008 |
| CN | 101286267 | 10/2008 |
| CN | 201784622 | 4/2011 |
| CN | 102081855 | 6/2011 |
| CN | 102097011 | 6/2011 |
| CN | 102169628 | 8/2011 |
| CN | 102222408 | 10/2011 |
| TW | I332454 | 11/2010 |
| TW | I347502 | 8/2011 |

OTHER PUBLICATIONS

Chewputtanagul et al, "A Road Recognition System Using GPS/GIS Integrated System", Proc. of 2004 IEEE Region 10 Conference (TENCON 2004), 2004, pp. 225-228.

Rong et al., "Study on Intelligent Control of Road Condition Perception and Forward Collision Warning System", Proc. of 2010 International Conference on Intelligent Computing and Integrated Systems (ICISS), 2010, pp. 285-289.

Mitropoulos et al., "Wireless Local Danger Warning Cooperative Foresighted Driving Using Intervehicle Communication", IEEE Transactions on Intelligent Transportation Systems 11(3), Sep. 2010, pp. 539-553.

"Office Action of Taiwan Counterpart Application", issued on Dec. 3, 2013, p. 1-p. 19.

"Office Action of China Counterpart Application", issued on Sep. 30, 2014, p. 1-p. 9.

* cited by examiner

| Symbol | Meaning | Symbol | Meaning |
|---|---|---|---|
| $N_i$ | number of vehicles having passed through exceptional road-condition event i | $\theta_N$ | vehicle sample number threshold |
| $c_i$ | confidence of exceptional road-condition event i | $\theta_c$ | $c^{th}$ order confidence threshold |
| $s_i$ | intensity of exceptional road-condition event i | | |
| $T'_i$ | basic time of exceptional road-condition event i | $\delta_i$ | duration of exceptional road-condition event i |
| $\alpha_i$ | basic time validity conversion coefficient | $\beta$ | duration validity conversion coefficient |
| $t_i$ | time from occurrence of exceptional road-condition event i to a time point when a vehicle travels through | $T_i$ | valid time threshold of exceptional road-condition event i |

Parameter definition

FIG. 7A

EXCEPTIONAL ROAD-CONDITION WARNING DEVICE, SYSTEM AND METHOD FOR A VEHICLE

CROSS-REFERENCE TO RELATED APPLICATION

This application claims the priority benefit of Taiwan application serial no. 100146222, filed on Dec. 14, 2011. The entirety of the above-mentioned patent application is hereby incorporated by reference herein and made a part of this specification.

BACKGROUND

1. Technical Field

The disclosure relates to an exceptional road-condition warning device, system and method for a vehicle.

2. Related Art

Existing warning systems for a vehicle mainly use a radar and a camera as sensing elements, and include Collision Warning with Full Auto Brake (CWFAB), Automatic Collision Avoidance System (ACAS), Blind Spot Information System (BSIS) and Lane Keeping Assist System (LKAS). Statistics by the National Police Agency (Taiwan) indicate that causes of traffic accidents leading to immediate death or death within 24 hours from the time the accident occurred include 14 types, including illegal overtaking, reverse driving, loss of control due to over-speed and illegal turning, among which up to ⅓ of the traffic accidents were caused by unawareness of exceptional road conditions, for example, occurred in road sections where various behaviors and events that may influence normal driving exist, such as average speed reduction, obstacles, bumps, dangerous downhill and frequent acceleration and deceleration, which shows the importance of warning of exceptional road conditions to safety of driving.

According to U.S. Pat. No. 7,679,499 published on Mar. 16, 2010, being a warning system proposed by Yasufumi Yamada, it is detected whether a driving operation of a specific driver is identical to a dangerous driving behavior previously recorded, and the driver is warned not to repeat the dangerous driving behavior. This patent discloses a driving behavior database, for recording previous dangerous driving behaviors of a specific driver in the road section. It is determined through comparison whether a current location of the vehicle is close to a dangerous driving historical record in the database, and if yes, a warning is provided in advance.

According to U.S. Pat. No. 7,057,532 published on Jun. 6, 2006, being a road safety warning system and method proposed by Michael Shafir and Yossef Shiri, a driver is alerted of an impending traffic sign such as no right turn or a speed limitation, it is judged whether a current control behavior of the driver complies with safety codes, and if not, a warning is provided to the driver. In the system disclosed by this patent, the traffic sign data is stored on-board the vehicle, and the content may be updated by a radio frequency (RF) transceiver.

According to US Patent Application Publication No. 2010/0207787 published on Aug. 19, 2010, being a system and method for alerting drivers to road conditions proposed by J. Corey Catten, it is judged by using map information and a vehicle sensing device whether the speed limit or average speed on a specific route changes. Generally, if a feature of change in speed limits for different road sections of a specific route is found from the map information, a warning event is formed. If a vehicle sensor finds that the average speed is different from the speed limit for the road section due to an event such as construction or traffic accident, a report is provided to the back end. If the vehicle monitoring device finds that the vehicle speed exceeds the average speed or speed limit, a warning is provided.

SUMMARY

An exceptional road-condition warning device, system and method for a vehicle are introduced herein.

One of a plurality of embodiments of the disclosure provides an exceptional road-condition warning device for a vehicle, which can be installed in a vehicle. The exceptional road-condition warning device for a vehicle includes a real-time sensing and warning unit and an advance sensing and warning unit. The real-time sensing and warning unit is used for obtaining vehicle dynamic data, and recognizing whether the vehicle dynamic data is an exceptional road condition, and if yes, transmitting a warning in real time, and reporting an exceptional road-condition event in response to the real-time sensing. The advance sensing and warning unit is used for obtaining vehicle positioning information and the exceptional road-condition warning event information, and comparing a warning location corresponding to the exceptional road-condition warning event information with the vehicle positioning information, so as to judge whether to generate a warning signal corresponding to the exceptional road-condition warning event information.

One of a plurality of embodiments of the disclosure provides an exceptional road-condition warning system for a vehicle, which includes a storage device, a cooperative self-learning unit and an advance sensing and warning unit. The storage device is used for storing a traffic information database, where the traffic information database is used for storing the exceptional road-condition warning event information. The cooperative self-learning unit is used for receiving the exceptional road-condition event in response to the real-time sensing, so as to determine whether to modify the exceptional road-condition warning event information stored in the traffic information database. The advance sensing and warning unit is used for obtaining the vehicle positioning information and the exceptional road-condition warning event information, and comparing a warning location corresponding to the exceptional road-condition warning event information with the vehicle positioning information, so as to judge whether to generate a warning signal corresponding to the exceptional road-condition event.

In an embodiment, the exceptional road-condition warning system for a vehicle further includes a real-time sensing and warning unit, for obtaining vehicle dynamic data, and recognizing whether the vehicle dynamic data is a real-time sensing and warning event, and if yes, transmitting the exceptional road-condition event in response to the real-time sensing to the cooperative self-learning unit, and warning a driver in real time.

In an embodiment, the exceptional road-condition warning system for a vehicle further includes an advance sensing and warning unit, for obtaining vehicle positioning information and the exceptional road-condition warning event information, and comparing a warning location corresponding to the exceptional road-condition warning event information with the vehicle positioning information, so as to judge whether to generate a warning signal corresponding to the exceptional road-condition event.

One of a plurality of embodiments of the disclosure provides an exceptional road-condition warning method for a vehicle, in which a back-end real-time event receiving module receives a plurality of exceptional road-condition events, so as to determine whether to modify a portion of exceptional road-condition warning event information stored in a traffic information database. The obtained traffic information database is synchronously updated to an in-vehicle warning location database, so as to maintain accuracy of the in-vehicle warning location database.

In an embodiment, the exceptional road-condition warning method for a vehicle further includes performing a real-time sensing procedure to obtain vehicle dynamic data, and recognizing whether the vehicle dynamic data is the exceptional road-condition event in response to the real-time sensing, and if yes, transmitting the exceptional road-condition event in real time.

In an embodiment, the real-time sensing procedure includes receiving sensing data, accordingly obtaining the vehicle dynamic data by analyzing the sensing data, and recognizing whether the vehicle dynamic data is the exceptional road-condition event in response to the real-time sensing.

Several exemplary embodiments accompanied with figures are described in detail below to further describe the disclosure in details.

BRIEF DESCRIPTION OF THE DRAWINGS

The accompanying drawings are included to provide further understanding, and are incorporated in and constitute a part of this specification. The drawings illustrate exemplary embodiments and, together with the description, serve to explain the principles of the disclosure.

FIG. 7A to FIG. 7E are schematic diagrams illustrating addition of a trusted event to exceptional road-condition warning events in a traffic information database according to one of a plurality of embodiments of the disclosure.

DETAILED DESCRIPTION OF DISCLOSED EMBODIMENTS

Figure 1:
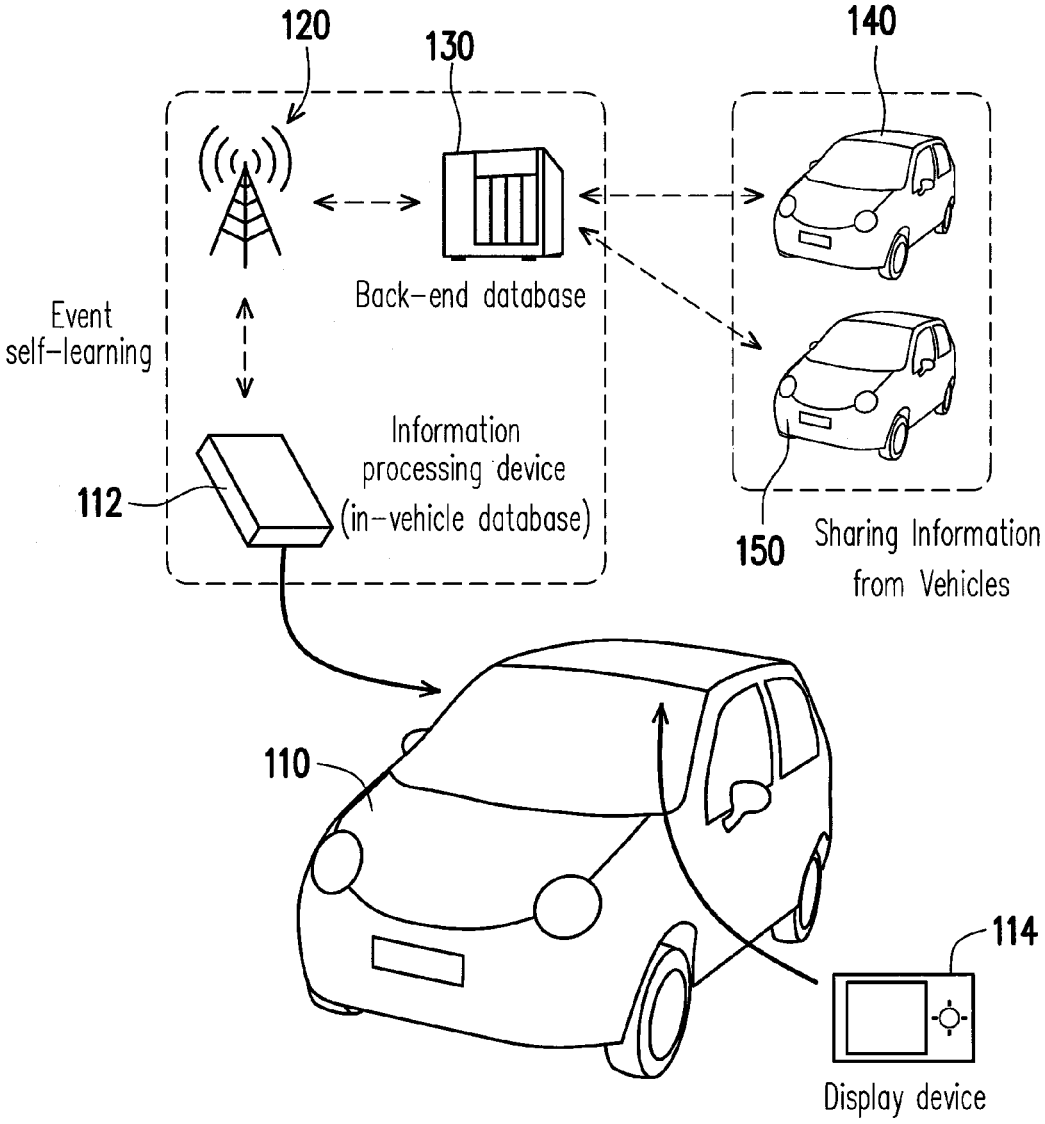
FIG. 1 is a schematic diagram illustrating an exceptional road-condition warning system for a vehicle provided in the disclosure, which includes an event self-learning mechanism.

The disclosure designs an exceptional road-condition warning system for a vehicle, in which an information processing device installed inside the vehicle observes and recognizes an exceptional road condition in front, so as to achieve the function of real-time warning, and at the same time, transmits the recognized exceptional road-condition event to a back end. Through a back-end cooperative self-learning mechanism, event information sensed by different vehicles may be verified and compared, so as to maintain accuracy of the back-end warning event database, and notification or warning events of different degrees are defined according to different confidences calculated. A traffic information database maintained by the back end is then synchronously updated to an in-vehicle warning location database, and exceptional road-condition location information of the in-vehicle warning location database is compared with a vehicle real-time location, so as to achieve the function of advance warning for an exceptional road-condition event.

The exceptional road-condition warning system for a vehicle designed in the disclosure provides an "exceptional road condition", including road information, lane information or any information related to abnormal roads suitable for driving. The exceptional road condition includes real-time road-condition information and long existing road-condition information, and such road-condition information is different from ordinary steady and moderate driving modes, and has some potential risks of easily distracting the driver, which may affect safety of driving. Real-time road conditions include, for example, traffic accidents and frequent acceleration and deceleration; and long existing road conditions include, for example, roads with abrupt turns. The road conditions are also conditions for judging whether a definition of an exceptional road-condition warning event is conformed to.

The exceptional road-condition warning system for a vehicle can provide real-time and advance warnings for ongoing and upcoming exceptional road conditions of the vehicle, so that the driver and passenger has more sufficient response time before the event occurs, thereby improving the ability of the driver and passenger to handle crisis, and reducing the possibility of injuries.

Moreover, the back-end cooperative self-learning mechanism may collect and analyze information of a plurality of lead vehicles traveling through the same road section or in the same driving direction, and provide the information to a successive vehicle predetermined to travel through the same road section, so that the successive vehicle makes a judgment, even according to different time periods or connected road section information, so as to find recommended road information, for example, may change the lane for driving, so as to save the time of driving, or may be recommended to preferentially avoid the road section having a high danger weight according to exceptional road-condition analysis and warning.

In addition, the back-end cooperative self-learning mechanism may collect information of a plurality of lead vehicles traveling through the same road section or in the same driving direction, so as to report the judged road condition to an administrative authority or a rescue agency as soon as possible, thereby removing consequential events or providing optimal assistance in real time. For example, a lead vehicle breaks down and needs help, at this time, a plurality of vehicles traveling through the same road section may report road-condition information sensed by the vehicle in real time, so as to facilitate rescue to remove the breakdown event timely.

In an embodiment, the exceptional road-condition warning system for a vehicle provided in the disclosure includes a driving dynamic data sensing unit and an exceptional road-condition event recognizing unit installed in the vehicle, and a back-end system includes a cooperative self-learning unit.

Exceptional road-condition warning provides the driver and passenger with the current driving state or environment and provides an advance warning for a possible impending exceptional road condition, so that the driver and passenger has more sufficient response time.

In a plurality of embodiments, the driving dynamic data sensing unit may acquire driving dynamic sensing data, for example, sensing data such as triaxial acceleration, angular velocity, steering angle, engine speed and vehicle speed of the vehicle during driving, through a sensor for vehicles such as a gyro, an accelerometer or an on-board diagnostics (OBD) system, so as to obtain dynamic data of the vehicle during driving.

The driving dynamic data sensing unit may be used in combination of an in-vehicle Global Positioning System (GPS) to provide dynamic data of the vehicle during driving, and then judge GPS changes of vehicles in the same driving direction by using information of the cooperative self-learning unit, so as to judge whether an exceptional road condition or abnormal event such as landslide or vehicle breakdown exists, thereby warning drivers of successive vehicles to change the route in advance.

In a plurality of embodiments, the exceptional road-condition event recognizing unit may judge by using a signal processing technology whether the travel information is an exceptional road-condition notification event or exceptional road-condition warning event.

In a plurality of embodiments, the cooperative self-learning unit uses dynamic data of a plurality of vehicles to implement automatic modifying exceptional road-condition warning events in the traffic information database of the back end, and synchronously updates the in-vehicle warning location database.

For the automatic record addition, in one of a plurality of embodiments, a result of recognition of an exceptional road-condition event is transmitted back to the back end. The back end determines whether the event is added to the database by comparing a confidence count corresponding to the event with a confidence threshold and accordingly to perform automatic record addition.

For the automatic record release, in one of a plurality of embodiments, a result of recognition of an exceptional road-condition event is transmitted back to the back end. The back end determines whether the event is released from the database by using a confidence count corresponding to the event, a confidence threshold, a valid time and a valid time threshold whether to update the event to the database, to perform automatic record release.

The exceptional road-condition warning system for a vehicle provided in the disclosure, as shown in FIG. 1, includes an event self-learning mechanism. The event self-learning mechanism is that, through a plurality of vehicles traveling through a road section, as shown in FIG. 1, by using an information processing device 112 (in-vehicle database) built in a vehicle 110, the driving dynamic sensing data of the vehicle is acquired, and exceptional road-condition information in the current driving environment is recognized, which may be transmitted to a back-end database 130 of a back-end cooperative self-learning unit through a wireless network 120, so as to establish and update the traffic information database of the back end through a cooperative self-learning mechanism, thereby achieving resource sharing and improving accuracy of warning. In addition to that information in response to the dynamically sensed data is transmitted back to the back-end database 130, related exceptional road-condition warning information may be obtained in advance from the cooperative self-learning unit of the back end, and displayed in a display device 114 in real time, so as to provide related information to the driver of the vehicle 110.

Vehicles traveling through the same road section, for example, vehicles 140 and 150 shown in the figure, may compare driving locations and warning location databases in the information processing devices thereof, so that when the vehicle approaches a location corresponding to an exceptional road-condition warning location, the system can actively display warning information in advance, so as to enable the driver and passenger to have more sufficient response time.

Figure 2:
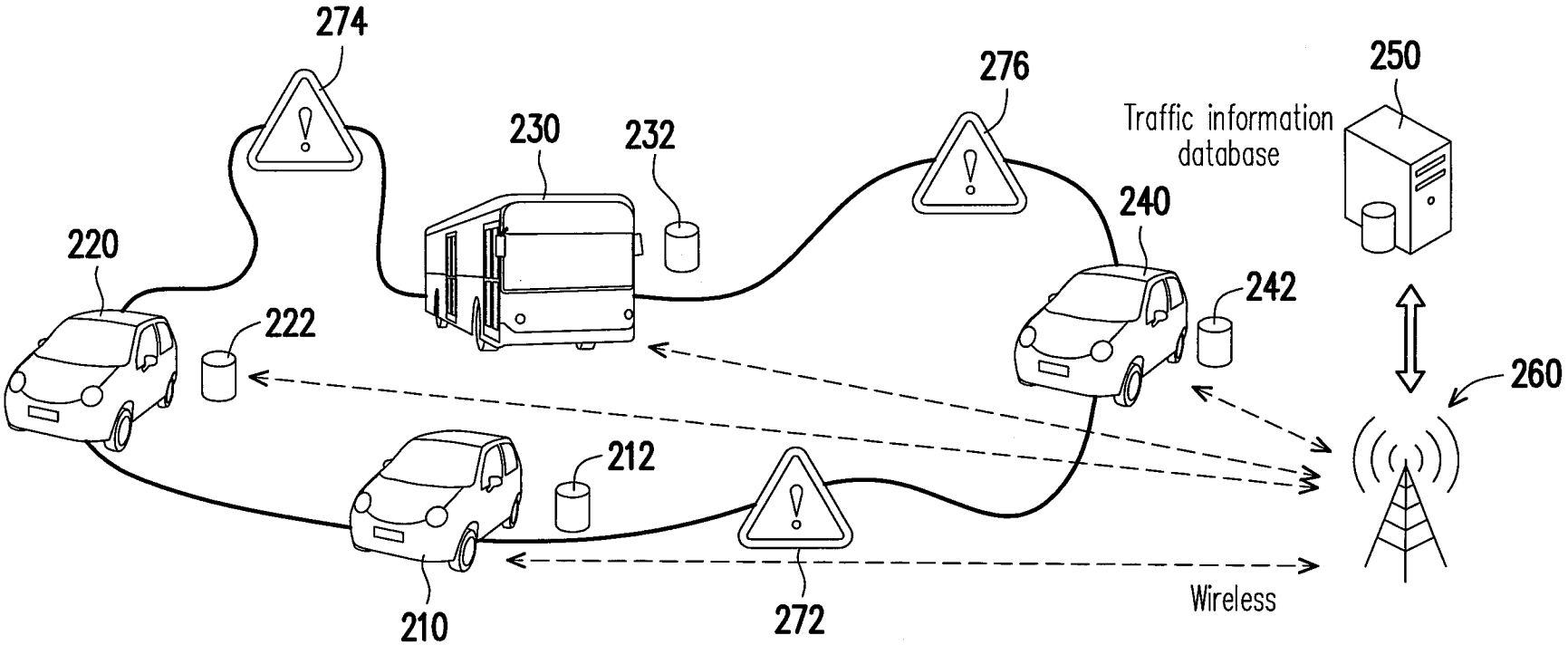
FIG. 2 is a schematic systematic diagram illustrating application of an exceptional road-condition warning system for a vehicle provided in the disclosure to a plurality of vehicles traveling on a road.

FIG. 2 is a schematic systematic diagram illustrating application of an exceptional road-condition warning system for a vehicle provided in the disclosure to a plurality of vehicles traveling on a road. On the same road, vehicles 210, 220, 230 and 240 are respectively equipped with information processing devices 212, 222, 232 and 242, and each of the information processing devices at least includes a warning location database. Currently, warning sites on the road include 272, 274 and 276, and the warning sites may be communicated and dynamically updated through the information processing devices, a wireless network 260 and a back-end database 250 of a back-end cooperative self-learning unit.

Here, illustration is given by taking the vehicle 210 as an example. Before the vehicle 210 passes by the warning site 272, related warning information may be obtained through the back-end database 250, and when the vehicle 210 approaches the warning site 272, the exceptional road-condition warning technology automatically provides the driver and passenger with the current driving environment and provides an advance warning for a possible impending exceptional road condition at the warning site 272, so that the driver and passenger has more sufficient response time.

After the vehicle 210 passes by the warning site 272, the information processing device 212 of the vehicle 210 may sense driving dynamic data, for example, may acquire driving dynamic sensing data through a sensor such as a gyro or an accelerometer, so as to obtain dynamic data of the vehicle during driving. The sensing data may be obtained by triaxial acceleration, angular velocity, steering angle, engine speed and vehicle speed of the vehicle during driving. The sensor may be a gyro or an accelerometer. The obtained dynamic data may be subjected to exceptional road-condition event recognition in real time, and a result of recognition is reported to the back-end cooperative self-learning unit in response to the sensing. Road-condition information summarized by a plurality of vehicles is used to implement automatic addition, update and release of exceptional road-condition warning events in the traffic information database of the back end.

The cooperative self-learning unit modifies a portion of the exceptional road-condition information in the traffic information database according to exceptional road-condition information recognized by dynamic data of a plurality of vehicles, and immediately synchronously updates the in-vehicle warning location database. For example, after judgment according to the dynamic data of a plurality of vehicles, if it is determined that the warning site 272 no longer requires warning; information of the back-end database 250 may be updated, added, released or the combine of the above. For a next vehicle, for example, the vehicle 240, the warning location database of the information processing device 242 obtains updated information, and will not receive exceptional road-condition information of the warning site 272.

Figure 3:
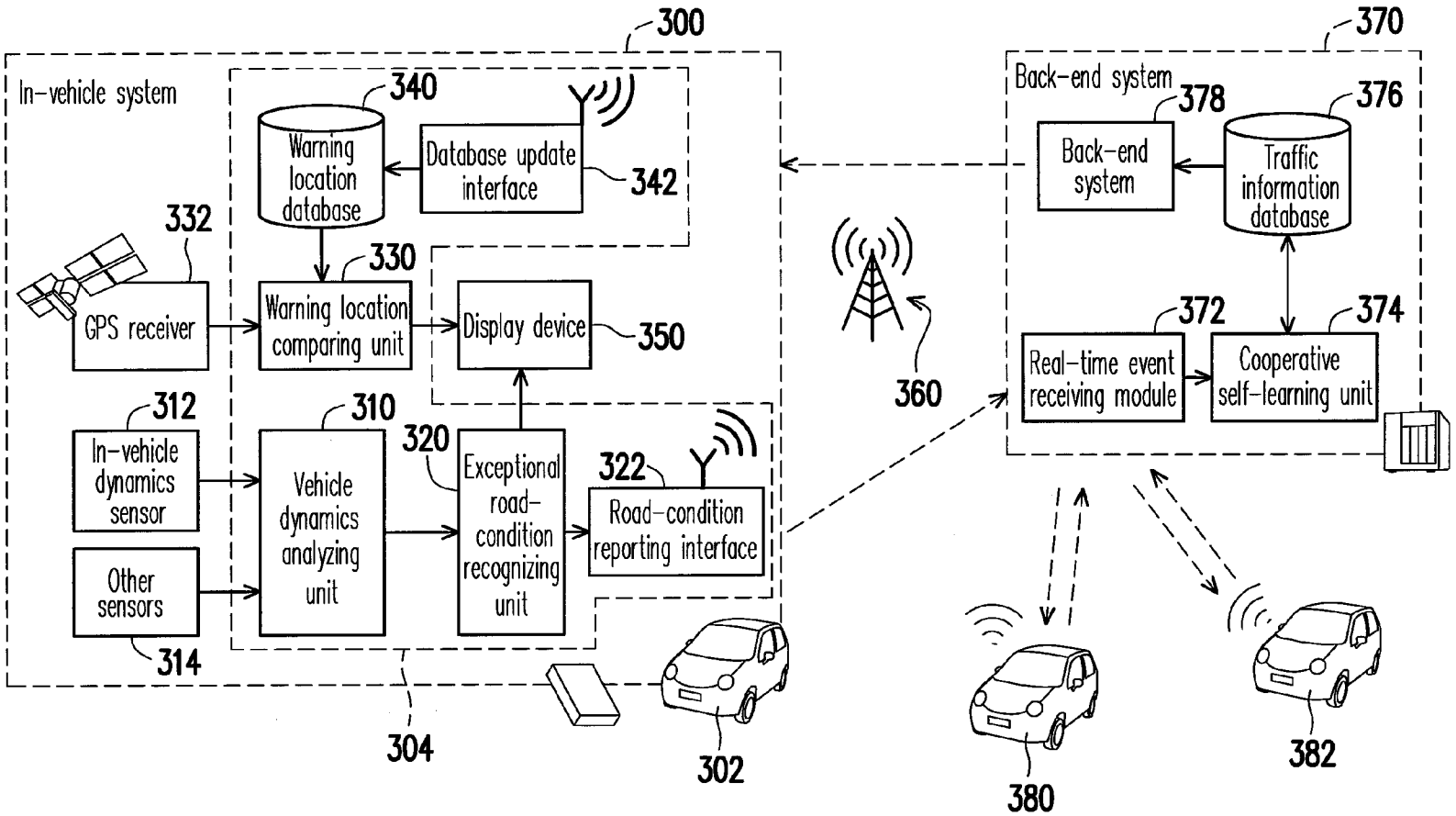
FIG. 3 is a schematic architectural diagram illustrating an exceptional road-condition warning system for a vehicle provided in the disclosure.

FIG. 3 is a schematic architectural diagram illustrating an exceptional road-condition warning system for a vehicle provided in the disclosure. The architecture of the exceptional road-condition warning system for a vehicle includes an in-vehicle system 300 and a back-end system 370.

The in-vehicle system 300 includes an exceptional road-condition warning device for a vehicle, which is located inside the vehicle, and includes an information processing device 304 and a display device 350. Each vehicle may be configured with an independent in-vehicle system 300, and here, a vehicle 302 is illustrated.

The back-end system 370 includes a real-time event receiving module 372, a cooperative self-learning unit 374, a traffic information database 376 and a database real-time update module 378. Exceptional road-condition warning event information of each vehicle is received from the in-vehicle system 300 of the vehicle 302 or in-vehicle systems of other vehicles through the real-time event receiving module 372, and then the cooperative self-learning unit 374 automatically compares the exceptional road-condition warning event from each vehicle to determine whether to modify the exceptional road-condition warning event, and further updates the content of the traffic information database 376. Through the database real-time update module 378, transmission to the in-vehicle system of each vehicle may be via any transmission medium. For example, transmission is performed through a wireless transmission system 360 shown in the figure, so as to implement bidirectional transmission between the back end and the in-vehicle system.

In an embodiment, the in-vehicle system 300 may include the information processing device 304 and the display device 350. The information processing device 304 may be installed inside the vehicle 302. The information processing device 304 includes a vehicle dynamics analyzing unit 310, an exceptional road-condition recognizing unit 320 and a warning location comparing unit 330.

The vehicle dynamics analyzing unit 310 acquires driving dynamic sensing data of the vehicle during driving. For example, the sensing data may be obtained by triaxial acceleration, angular velocity, steering angle, engine speed and vehicle speed of the vehicle during driving. The in-vehicle dynamics sensor 312 or other sensors 314, in one embodiment, may be various sensors inside or outside the vehicle, such as a gyro or an accelerometer, so as to obtain dynamic data of the vehicle during driving. In one embodiment, the in-vehicle dynamics sensor 312 or other sensors 314 may be an existing basic equipment inside the vehicle 302. In other embodiment, the in-vehicle dynamics sensor 312 or other sensors 314 may be configured inside the information processing device 304 according to different functions. The in-vehicle dynamics sensor 312 or other sensors 314 may be connected to the information processing device 304 through an interface, depending on design requirements.

The in-vehicle system 300 further includes an in-vehicle database, stored in a storage device, for storing exceptional road-condition information. For example, a warning location database 340 shown in the figure may be stored in a storage space of the information processing device 304 or other devices, for example, in a removable memory. A database update interface 342 may communicate with the real-time event receiving module 372 of the back-end system 370, so as to update exceptional road-condition information stored in the warning location database 340. The warning location comparing unit 330 receives vehicle location information generated by a device for generating vehicle positioning information. The device is, for example, a GPS receiver 332 shown in the figure. The warning location comparing unit 330 further obtains the exceptional road-condition information from the warning location database 340, which is displayed through the display device 350 after comparison, so as to alert the driver to notice the upcoming exceptional road condition.

In the architecture of the exceptional road-condition warning system for a vehicle, the exceptional road-condition recognizing unit 320 and the warning location comparing unit 330, installed inside the vehicle, collect driving dynamic sensing data of the vehicle, and communicate with the back-end system 370 through a related road-condition reporting interface 322. The event judged by the exceptional road-condition recognizing unit 320 not only may be displayed inside the vehicle through the display device 350 in real time to alert the driver, but may also be synchronously transmitted to the back-end system 370, so as to provide transaction of the back-end system 370 for the traffic information database.

The back-end system 370 functions to process exceptional road-condition information recognized by all the vehicles, performs filtering, intensity detection, confidence calculation and automatic update of the traffic information database 376 through the cooperative self-learning unit 374, and updates the exceptional road-condition location information to the in-vehicle warning location database 340 in real time through transmission between the database real-time update module 378 and the database update interface 342 via a wireless network 360.

To achieve the objectives of the disclosure, the vehicle positioning information is compared with the exceptional road-condition information in the in-vehicle database in real time through the warning location comparing unit inside the vehicle. The comparing result may be used to warn the driver of impending exceptional road-condition information in advance before the vehicle approaches the exceptional road condition, so as to ensure safety of the driver during driving.

Figure 4A:
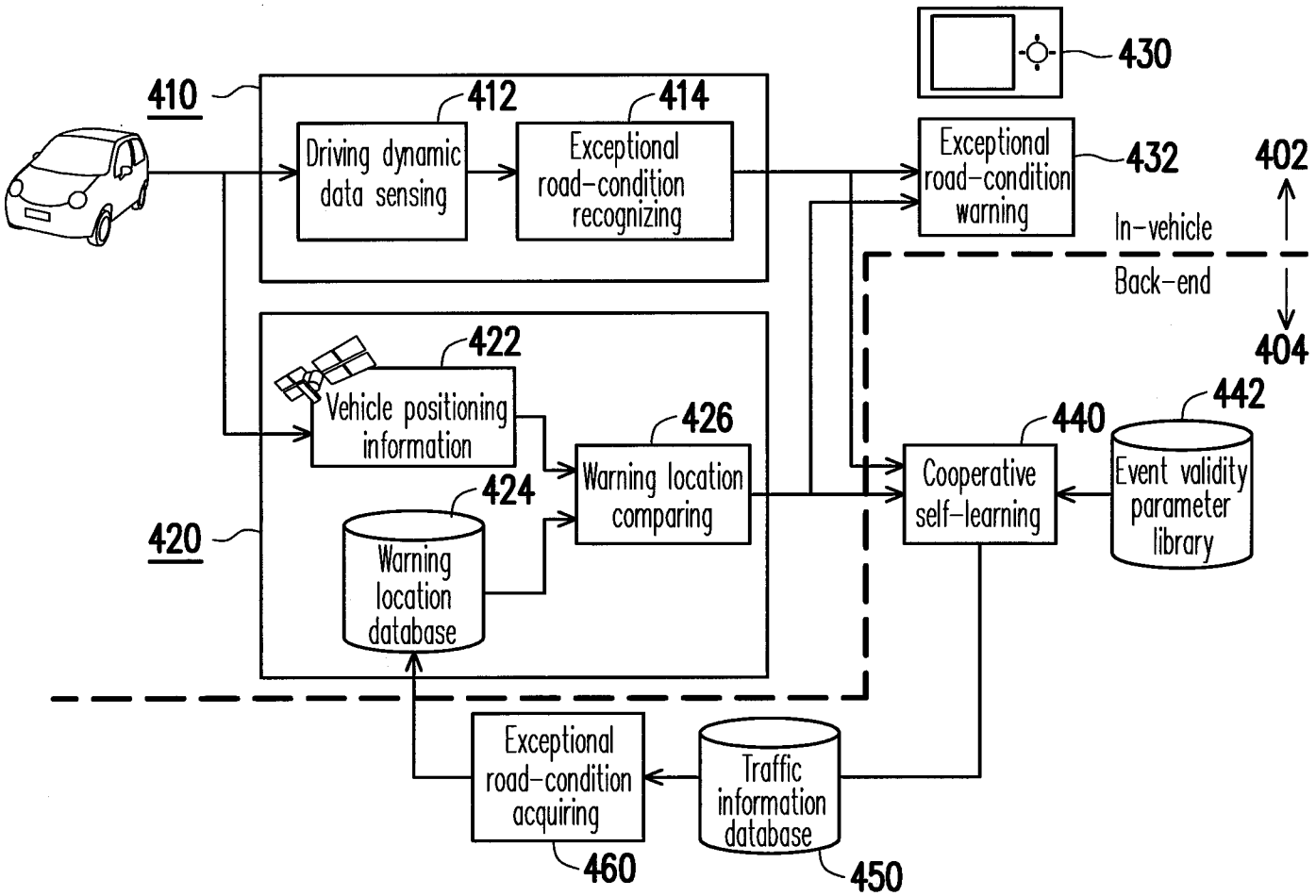
FIG. 4A is a schematic diagram illustrating a specific technical process of an exceptional road-condition warning system for a vehicle of the disclosure.

FIG. 4A is a schematic diagram illustrating a specific technical process of an exceptional road-condition warning system for a vehicle of the disclosure. This process is mainly divided into an in-vehicle operation process 402 and a back-end operation process 404. The in-vehicle operation process 402 includes a real-time sensing and warning unit 410 and an advance sensing and warning unit 420. The real-time sensing and warning unit 410 includes a driving dynamic data sensing process 412 and an exceptional road-condition recognizing process 414. The driving dynamic data sensing process 412 acquires vehicle dynamic sensing information. The exceptional road-condition recognizing process 414 recognizes whether the current driving road condition is a dangerous exceptional road-condition event, for example, road section with obstacles, road section with bumps or road section with frequent acceleration and deceleration.

The advance sensing and warning unit 420 implements a plurality of functions, including a process for vehicle positioning information, a process for warning location comparing. In the process 422, vehicle positioning information of the vehicle is obtained. In the process 426, warning locations of a warning location database 424 are respectively compared with the vehicle positioning information to determine whether the vehicle is approaching the locations in response to the exceptional road condition stored in the database. If yes, warning information such as a warning signal is generated in advance to alert the driver. For example, the driver is noticed beforehand through a process 432 for exceptional road-condition warning. The process 432, for example, includes notifying the driver through an in-vehicle display 430. The in-vehicle warning location database 424 is obtained from the traffic information database 450 through an exceptional road-condition acquiring process 460. The in-vehicle warning location database 424 stores the information related to exceptional road conditions, such as road condition type, occurring place, occurring time, duration and intensity. The in-vehicle warning location database 424 acquires critical warning information such as road condition type and occurring place from the traffic information database 450 through the exceptional road-condition acquiring process 460. When the traffic information database 450 is updated, the warning location database 424 may also synchronously update the stored exceptional road-condition information in the subsequent update procedure.

The back-end operation process includes a cooperative self-learning step 440, which is performed not only according to received exceptional road-condition warning events sensed by vehicles traveling through the same road section, but further with reference to the content of an event validity parameter library 442. The cooperative self-learning step 440 includes filtering the exceptional road-condition warning events sensed by the vehicles traveling through the same road section, and synchronously updating and recording the events to the traffic information database 450, so as to maintain accuracy of the database.

According to the above technical flow chart, main operational mechanisms such as the real-time sensing and warning unit, the advance sensing and warning unit and cooperative self-learning are described in detail below.

Figure 4B:
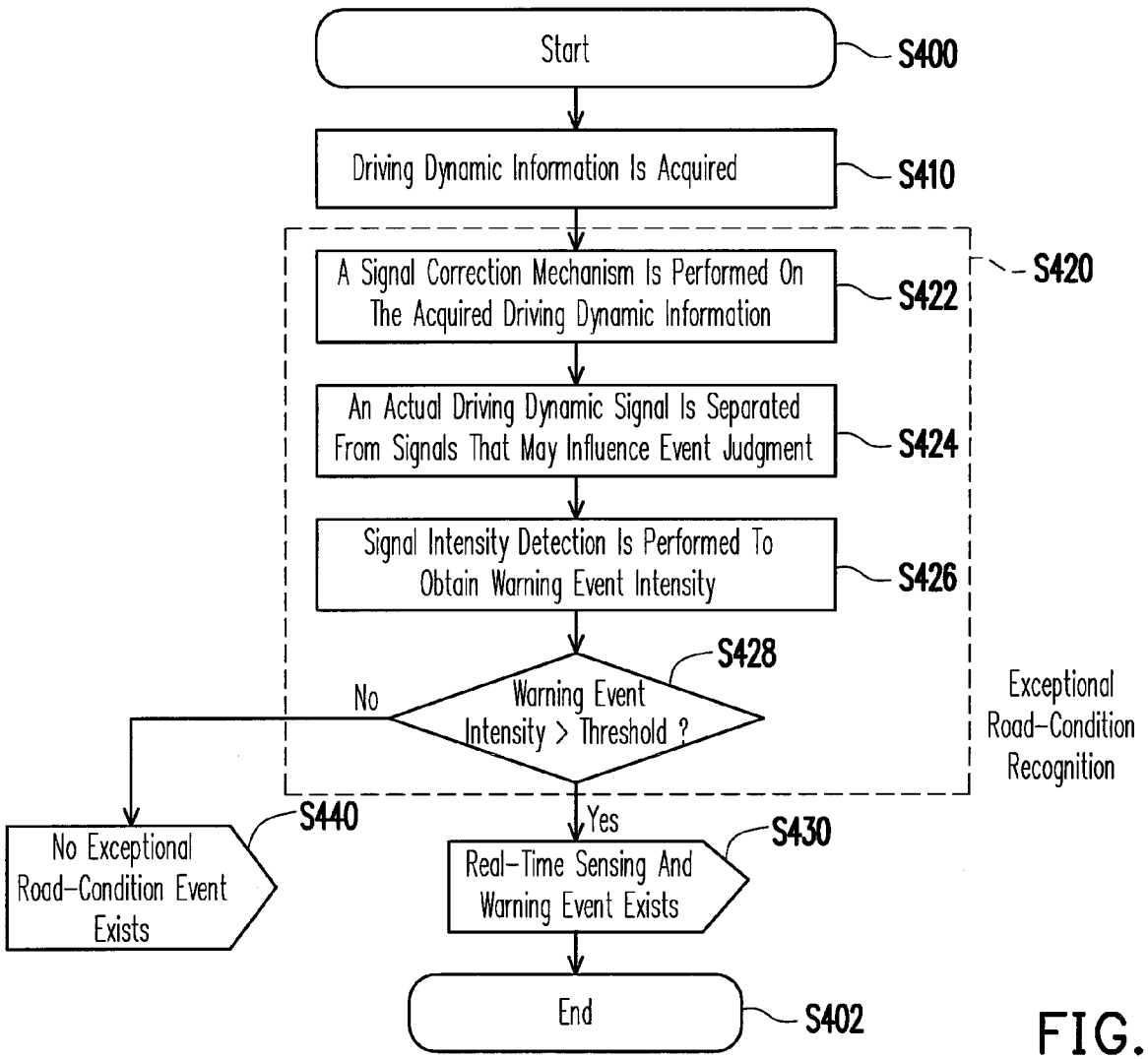
FIG. 4B is a schematic flow chart illustrating operation of a real-time sensing and warning unit according to one of a plurality of embodiments.

FIG. 4B is a schematic flow chart illustrating operation of a real-time sensing and warning unit according to one of a plurality of embodiments.

In Step S400, a real-time sensing and warning unit is started. In Step S410, vehicle driving dynamic information is synchronously acquired first, including acquiring driving dynamic sensing data through various sensors. The dynamic sensing data may be obtained by, for example, sensing data such as triaxial acceleration, angular velocity, steering angle, engine speed and vehicle speed of the vehicle during driving. The sensors configured on the vehicle may be a gyro or an accelerometer, so as to obtain dynamic data of the vehicle during driving.

In Step S420, exceptional road-condition recognition is performed, which, for example, includes Steps S422 to S428 shown in the figure.

First, in a signal correction process of Step S422, for the current driving sensing dynamic data, possible noise or reference value offset is compensated through a signal correction mechanism. In Step S424, through a multiple signal separation mechanism, an actual driving dynamic signal is separated from signals that may influence event judgment (for example, idle speed, shaking or passenger movement). In Step S426, signal intensity detection is performed to obtain warning event intensity, for example, through signal intensity judgment or duration filtering, after the actual driving dynamic signal is obtained. Then, in Step S428, it is judged whether the warning event intensity is larger than a threshold. If the warning event intensity is larger than the threshold, it is judged that a warning event such as a real-time sensing and warning event exists, as in Step S430. Otherwise, it is determined that there is no warning event, which means no exceptional road-condition event occurs. By comparing feature values of exceptional road conditions, current exceptional road-condition information of the vehicle is recognized.

The recognized real-time sensing and warning event not only warns the driver of the current exceptional road-condition information in real time, but also is synchronously transmitted to the back end, for the cooperative self-learning mechanism to perform database filtering, intensity detection, confidence calculation and automatic update.

Figure 4C:
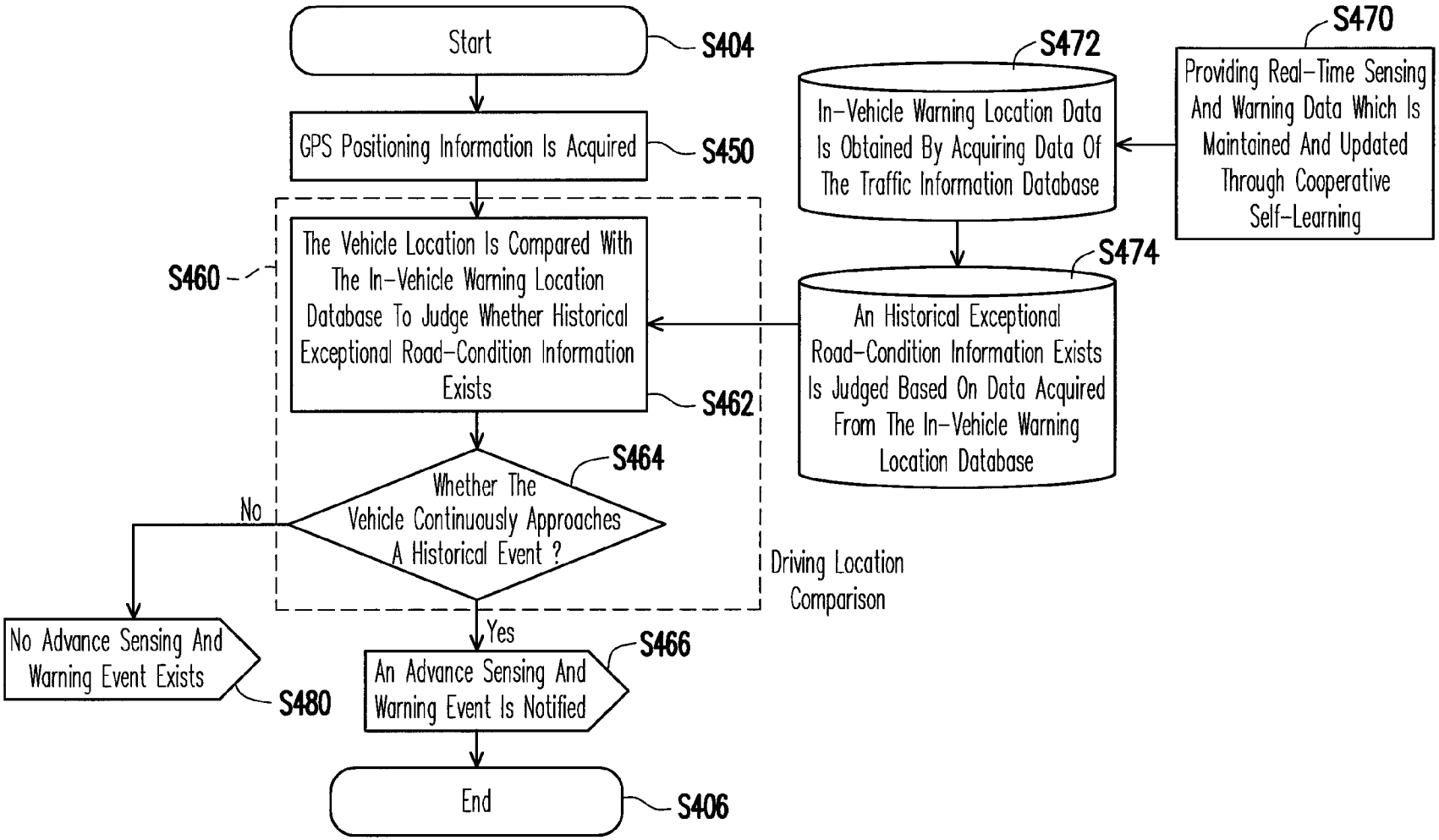
FIG. 4C is a schematic flow chart illustrating operation of an advance sensing and warning unit according to one of a plurality of embodiments.

FIG. 4C is a schematic flow chart illustrating operation of an advance sensing and warning unit according to one of a plurality of embodiments.

After the advance sensing and warning unit is started in Step S404, in Step S450, GPS positioning information is acquired first, so as to update the latest current location and time of the vehicle.

In Step S460, driving location comparison is performed, which includes Steps S462 to S464. In Step S462, the vehicle location is compared with the in-vehicle warning location database to judge whether historical exceptional road-condition information exists near the current location of the vehicle. Whether historical exceptional road-condition information exists is judged based on data acquired from the in-vehicle warning location database, as in Step S474. The in-vehicle warning location data is obtained by acquiring data of the traffic information database of the back end, as in Step S472. Data source of the traffic information database is obtained from real-time sensing and warning data maintained and updated through cooperative self-learning, as in Step S470.

In Step S464, it is judged whether the vehicle continuously approaches a historical event. If yes, that is, when it is judged that the vehicle approaches the historical event, an advance sensing and warning event is notified in Step S466, for example, information related to the exceptional road condition is acquired, and synchronously displayed in an in-vehicle display device, so as to warn the driver and passenger. If the vehicle does not approach the historical event, it is determined in Step S480 that no advance sensing and warning event exists.

Figure 5:
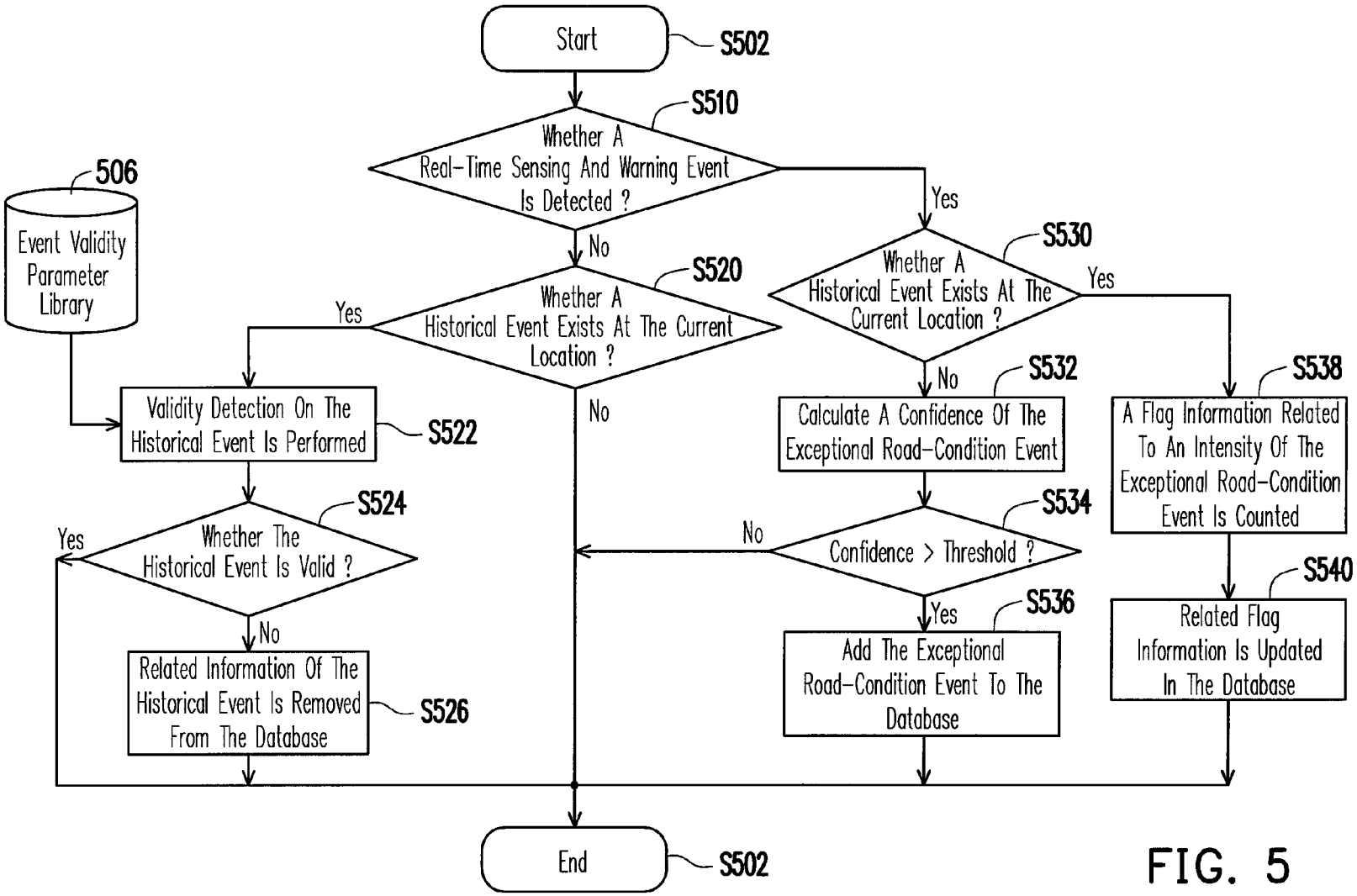
FIG. 5 is a schematic flow chart illustrating operation of one of a plurality of embodiments of a cooperative self-learning mechanism in the architecture of an exceptional road-condition warning system for a vehicle provided in the disclosure.

FIG. 5 is a schematic flow chart illustrating operation of one of a plurality of embodiments of a cooperative self-learning mechanism in the architecture of an exceptional road-condition warning system for a vehicle provided in the disclosure. In this operation process, a real-time update mechanism for databases inside and outside the vehicle is provided for the exceptional road-condition information recognized by the vehicle. It can be known from FIG. 5 that, the cooperative self-learning process may be divided into four processing mechanisms based on whether an exceptional road condition exists, which will be respectively introduced below.

In Step S502, a cooperative self-learning mechanism is started.

In Step S510, it is judged whether the vehicle detects a real-time sensing and warning event, for example, an exceptional road-condition warning event. Then, it is judged whether the traffic information database has stored historical road-condition information at the same location, so as to perform several corresponding processes.

Processing mechanism I: In Step S510, if the vehicle does not detect a real-time sensing and warning event at this location, and it is determined in Step S520 that no historical exceptional road-condition information exists at this location, the self-learning mechanism is directly ended in Step S502.

Processing mechanism II: In Step S510, if the vehicle detects a real-time sensing and warning event at this location, but it is determined in Step S530 that no historical exceptional road-condition information exists at this location, the system automatically calculates a confidence of this exceptional road-condition event in Step S532. Then, in Step S534, the confidence of the event is compared with a threshold to determine whether the confidence of the event is greater than the threshold. For example, a confidence count corresponding to the event is compared with a confidence threshold. If the confidence of the event is larger than the threshold, in Step S536, the event is considered as valid exceptional road-condition information, and added to the traffic information database, so as to provide an exceptional road-condition warning to other vehicles having the same route when traveling through this road section. If the confidence is smaller than the threshold, the self-learning mechanism is directly ended in Step S502.

Processing mechanism III: In Step S510, if the vehicle detects a real-time sensing and warning event at this location, and it is judged in Step S530 that historical exceptional road-condition information exists at or is close to this location, it indicates that this road condition already exists in the database and really has been detected by other vehicles traveling through this road condition. At this time, in Step S538, a flag information related to an intensity of the exceptional road-condition event is counted, for example, automatically counted up, indicating that the intensity of the event increases, and in Step S540, the related flag information in the database is updated, and then the process is ended.

Processing mechanism IV: In Step S510, if the vehicle does not detect a real-time sensing and warning event at this location, and it is judged in Step S520 that historical exceptional road-condition information exists at this location, Step S522 is performed, in which the system automatically performs validity detection on the historical event, with reference to an event validity parameter library 506. Step S524 is performed to judge whether the historical event is still valid, and if yes, the historical event is maintained, and continuously detected. On the contrary, if not, the system automatically removes related information of the historical event from the database in Step S526. In an embodiment, the event validity detection is mainly based on the confidence and time.

The cooperative self-learning mechanism synchronously updates crucial information such as event type and location in the traffic information database to the in-vehicle warning location database through various possible wireless network interfaces, so as to enable all vehicles traveling through the same road section to have the latest and most reliable exceptional road-condition information.

In Step S522 that the system automatically performs validity detection on this historical event, for the validity detection of the historical event, it needs to judge whether the historical event is valid with reference to a validity parameter library. The validity detection includes using confidence and event occurring time to enable the system to perform validity detection on exceptional road conditions of different intensities, types or durations. The cooperative self-learning mechanism mainly uses the real-time road-condition recognition results of the vehicles traveling through the same road section, and synchronously updates historical information in the database, thereby achieving resource sharing and self-learning.

Figure 6:
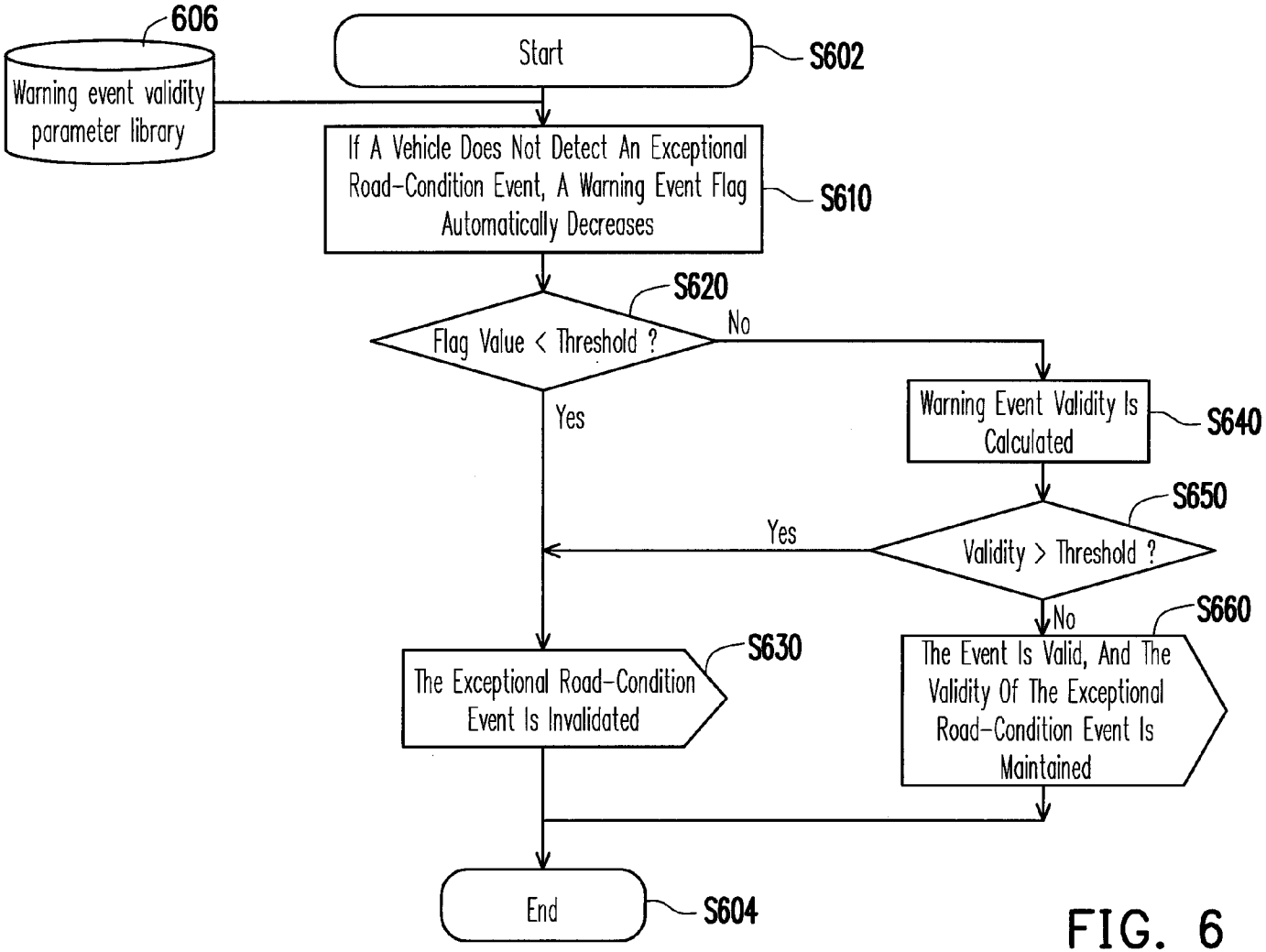
FIG. 6 is a schematic flow chart of judging validity of an exceptional road-condition warning event.

FIG. 6 is a schematic flow chart of a process of judging whether an exceptional road-condition warning event is valid, which is required for adding an exceptional road-condition event to a traffic information database and deleting an exceptional road-condition event from the traffic information database.

In Step S602, judgment of an exceptional road-condition warning event is started, and a warning event validity parameter library 606 is used as a basis of judgment. In Step S610, if a vehicle does not detect an exceptional road-condition event, a warning event flag automatically decreases, where the warning event flag value is, for example, according to whether the vehicle detects an exceptional road-condition event, that is, for example, the confidence of the event.

Then, in Step S620, it is judged whether the flag count is smaller than a threshold, where the threshold is, for example, a confidence threshold. If yes, the exceptional road-condition event is invalidated in Step S630. If not, Step S640 is further performed to calculate warning event validity. For example, time from last time when a detected exceptional road-condition event is transmitted back to the present time, which is calculation of a warning event valid time and a valid time threshold. In Step S650, it is judged according to the result of calculation whether the calculated validity value is larger than the valid time threshold, and if yes, the exceptional road-condition event is invalidated in Step S630. If not, the validity of the exceptional road-condition event is maintained in Step S660.

According to the above process, a learning process of a cooperative self-learning algorithm is described in detail below through two embodiments including addition of an exceptional road-condition event to the traffic information database and deletion of an exceptional road-condition event from the traffic information database.

First, parameters required by the algorithm are defined, as shown in Table 1 below.

TABLE 1

Algorithm Parameter Table

| Parameter | Definition |
|---|---|
| $c_i$ | confidence of exceptional road-condition event i |
| $s_i$ | intensity of exceptional road-condition event i |
| $T_i$ | valid time threshold of exceptional road-condition event i |
| $\beta_i$ | duration validity conversion coefficient |
| $N_i$ | number of vehicles having passed through exceptional road-condition event i |
| $\theta_N$ | vehicle sample number threshold |
| $T_i'$ | basic time of exceptional road-condition event i |
| $\delta_i$ | duration of exceptional road-condition event i |
| $\theta_c$ | $c^{th}$ order confidence threshold |
| $t_i$ | time from occurrence of exceptional road-condition event I to a time point when a vehicle travels through |
| $\alpha_i$ | basic time validity conversion coefficient |

A process of adding a trusted event to the traffic information database is as follows:

1. If a vehicle passes by a warning site i, and detects occurrence of a warning event, $S_i=S_i+1$, that is, the intensity of the exceptional road-condition event i is increased by 1; otherwise, $S_i$ remains unchanged.

2. If $N_i \geq \theta_N$, that is, the number $N_i$ of vehicles having passed through the exceptional road-condition event i is larger than or equal to the vehicle sample number threshold $\theta_N$, $c_i=S_i/N_i$.

3. If $c_i \geq \theta_c$, that is, the $c^{th}$ order confidence threshold, the warning event detected at the warning site i is a trusted event, and the exceptional road-condition event is added to the traffic information database.

In the above algorithm, the exceptional road-condition event i occurring at the warning site i needs to have a sufficient confidence $c_i$ in order to be stored in the traffic information database. If a vehicle passes by the warning site i and also detects the exceptional road-condition event i like the previous vehicle, the intensity $S_i$ is accumulated, indicating that the exceptional road-condition event i continuously occurs, and accordingly, the confidence $c_i$ also continuously increases. If a vehicle passes by the warning site i and does not detect the exceptional road-condition event i, the intensity $S_i$ remains unchanged, indicating that the exceptional road-condition event i is disappearing, and accordingly, the confidence $c_i$ decreases. If the confidence $c_i$ satisfies the condition of the first order confidence threshold:

$$c_i \geq \theta_1$$

the exceptional road-condition event i is stored in the traffic information database.

In addition, a process of deleting a trusted event from the traffic information database is as follows:

1. If a vehicle passes by the warning site i, and detects occurrence of a warning event within a time interval $\delta_i$, $S_i=S_i+1$, that is, the intensity of the exceptional road-condition event i is increased by 1; otherwise, $S_i$ remains unchanged.

2. $c_i=S_i/N_i$.

3. $T_i=T_i'\times\alpha_i+\delta_i\times\beta_i$, that is, the valid time threshold $T_i$ of the exceptional road-condition event i is the basic time $T_i'$ of the exceptional road-condition event i multiplied by the basic time validity conversion coefficient $\alpha_i$ plus the duration $\delta_i$ of the exceptional road-condition event i multiplied by the duration validity conversion coefficient $\beta_i$.

4. If $c_i<C_i$ or $t_i<T_i$, that is, the confidence $c_i$ is smaller than the $c^{th}$ order confidence threshold $\theta_c$, or time $t_i$ during which the event does not occur is smaller than the threshold $T_i$ of the valid time i, indicating that the warning event is not continuously detected at the warning site i, or the warning event is not detected for a certain period of time, the exceptional road-condition event is deleted from the traffic information database.

Whether to maintain each event i in the traffic information database may be determined based on the confidence and time. First, a first mode for judging whether to delete an invalid exceptional road-condition event is based on the confidence, with its condition being:

$$c_i<\theta_1$$

If the above equation is satisfied, indicating that the number of times of occurrence of the exceptional road-condition event i is small enough, it may be considered that the event has recovered to a certain degree, and accordingly, the exceptional road-condition event i in the traffic information database may be deleted. Moreover, the time of the exceptional road-condition event i may also be judged, and the time may take into account the basic time $T_i'$ and the duration $\delta_i$ of the exceptional road-condition event i, generally, exceptional road-condition events i that are severe and last for a long time require a long recovery time, and accordingly a judgment time threshold may be designed as $$T_i=T_i'\times\alpha_i+\delta_i\times\beta_i$$

where the basic time $T_i'$ is proportional to the severity of the exceptional road-condition event i occurring for the last time; the duration $\delta_i$ is a duration of the exceptional road-condition event i occurring for the last time; the coefficient $\alpha_i$ decreases as the intensity $s_i$ decreases; and the coefficient $\beta_i$ decreases as the time $t_i$ decreases. If $$t_i\geq T_i$$

is satisfied, that is, a next exceptional road-condition event is detected after the time $t_i$, but the time already exceeds the judgment time threshold, indicating that the valid time of the exceptional road-condition event expires, the exceptional road-condition event i in the traffic information database may be deleted. This is a second mode for judging whether to delete an invalid exceptional road-condition event.

FIG. 7A to FIG. 7E are schematic diagrams illustrating addition of a trusted event to exceptional road-condition warning events in a traffic information database according to one of a plurality of embodiments of the disclosure.

A parameter definition table of FIG. 7A may be provided with reference to the content of Table 1, and includes:

- $N_i$: number of vehicles having passed through exceptional road-condition event i
- $c_i$: confidence of exceptional road-condition event i
- $s_i$: intensity of exceptional road-condition event i
- $\theta_N$: vehicle sample number threshold
- $\theta_c$: $c^{th}$ order confidence threshold
- $T_i$: valid time threshold of exceptional road-condition event i
- $T_i'$: basic time of exceptional road-condition event i
- $t_i$: time from occurrence of exceptional road-condition event I to a time point when a vehicle travels through
- $\delta_i$: duration of exceptional road-condition event i
- $\alpha_i$: basic time validity conversion coefficient
- $\beta_i$: duration validity conversion coefficient Referring to FIG. 7B, assuming that a location C (120.27, 24.19) has a potential exceptional road-condition event 1, the number $N_1$ of vehicles having passed through the exceptional road-condition event 1 is 7, and the current intensity $s_1$ of the exceptional road-condition event 1 is 4, the current confidence of the exceptional road-condition event 1 may be calculated as $$c_1=(s_1/N_1)=4/7=0.5714$$

It is defined that the vehicle sample number threshold $\theta_N$ is 2, the first order confidence threshold $\theta_1$ is 55%, the second order confidence threshold $\theta_2$ is 60%, and the third order confidence threshold $\theta_3$ is 65%. An event reaching the first order confidence threshold is represented by G (green), an event reaching the second order confidence threshold is represented by Y (yellow), and an event reaching the third order confidence threshold is represented by R (red). The use of warning marks or signals of different levels to represent different confidence thresholds belongs to a multilevel advance notification and warning mechanism, and the number of levels may be adjusted according to the use frequency or importance of different road sections, and is not limited to three. By adopting marks of different colors, the driver or passenger of vehicle is enabled to directly distinguish the urgency or importance according to the color, and this is also one of different implementations of this embodiment.

As the confidence $c_1$ of the exceptional road-condition event 1 is 0.5714, which is larger than the first order confidence threshold $\theta_1$ (55%) but smaller than the second order confidence threshold $\theta_2$ (60%), the exceptional road-condition event 1 is an exceptional road-condition event reaching the first order confidence threshold, and thus is represented by S1-G as shown in the figure.

Figure 7B:
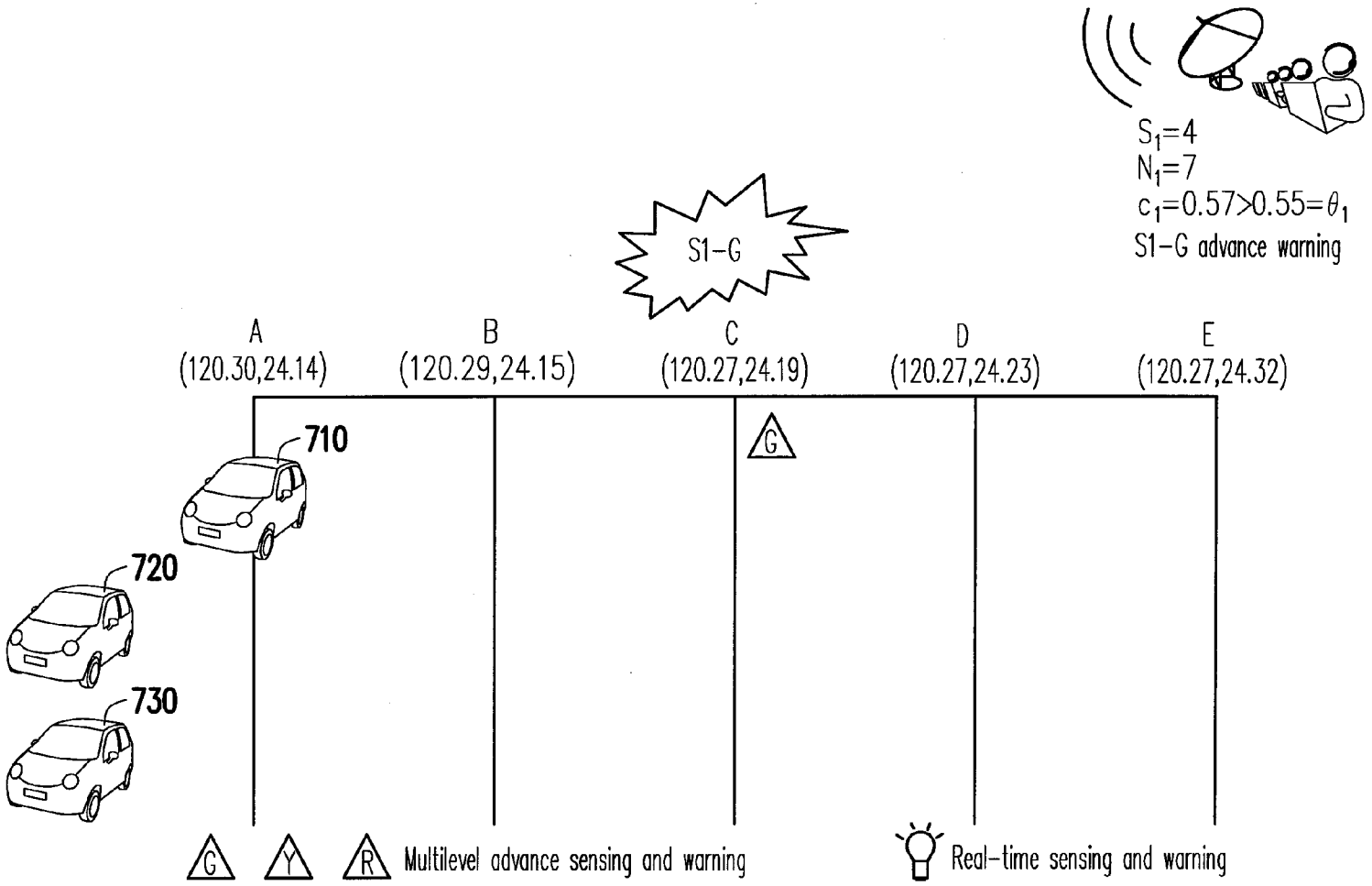
Figure 7C:
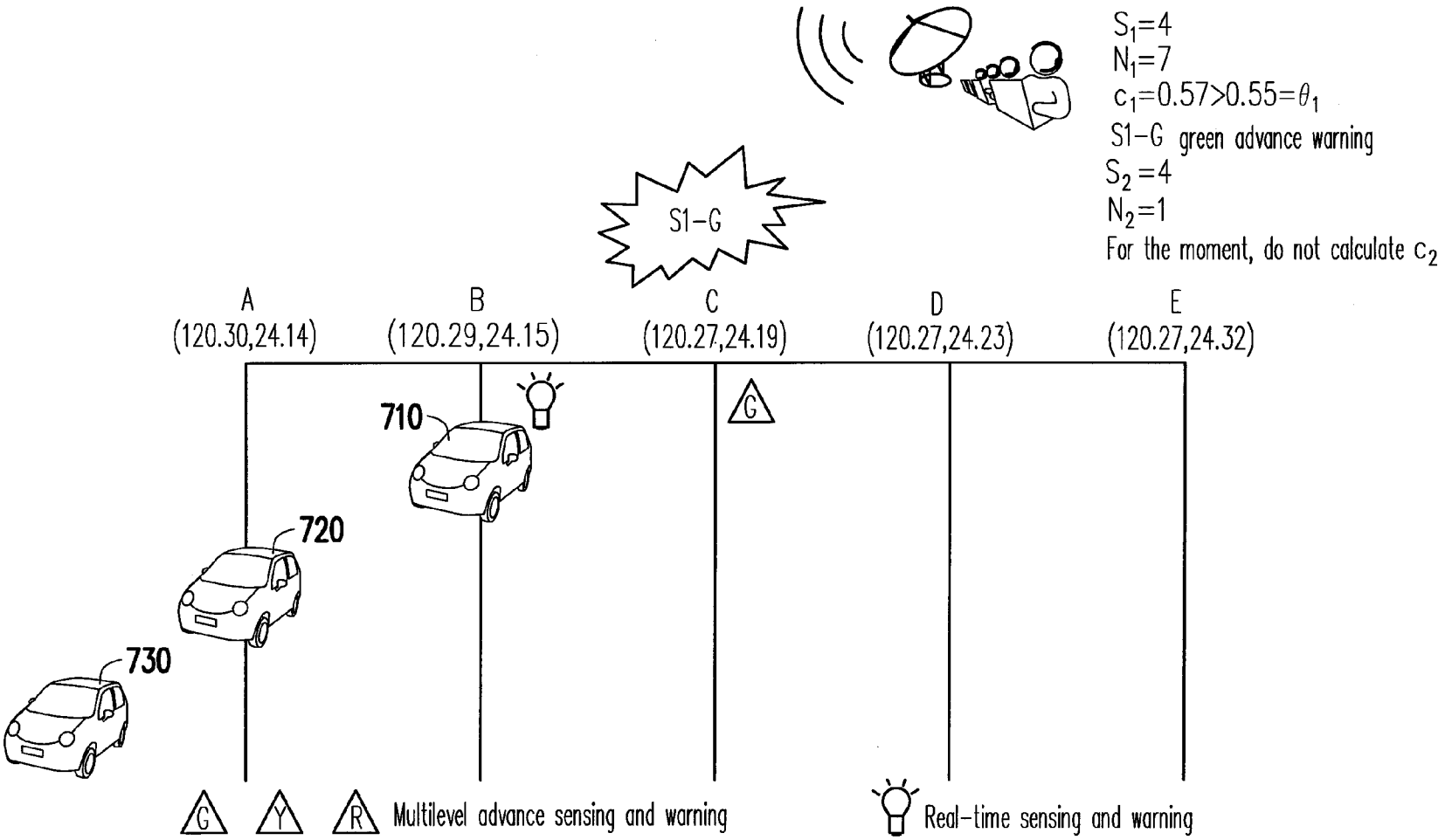

Referring to FIG. 7C, detection of a new exceptional road-condition event is taken as an example. A vehicle 710 detects a new exceptional road-condition event 2 at a location B (120.29, 24.15), the back end records that the intensity $s_2$ of the exceptional road-condition event 2 is 1. As $N_2=1$, the confidence $c_2$ of the exceptional road-condition event 2 is not calculated for the moment.

Figure 7D:
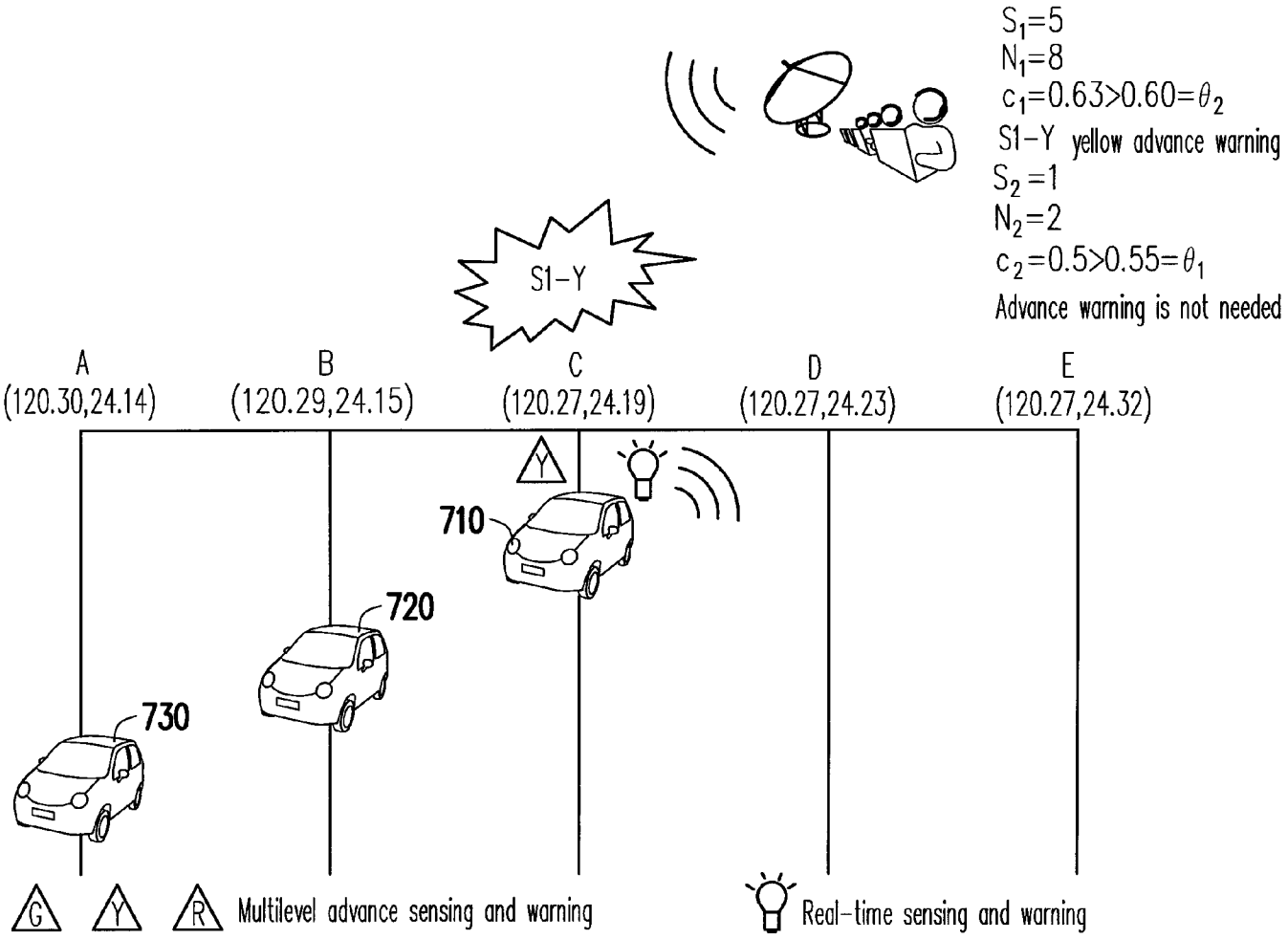

Then, as shown in FIG. 7D, the vehicle 710 arrives at a location C (120.27, 24.19), receives an S1-G advance sensing warning, and detects the exceptional road-condition event, that is, the exceptional road-condition event still exists. Therefore, the intensity of the exceptional road-condition event is recalculated as $$s_1=4+1=5$$

the confidence of the exceptional road-condition event 1 is calculated as $$c_1=5/8=0.625$$

As $c_1>\theta_2$ is satisfied at this time, the exceptional road-condition event 1 is upgraded to a Y (yellow) warning, marked as "S1-Y" as shown in the figure. At this time, a vehicle 720 arrives at the location B (120.29, 24.15), and does not detect the exceptional road-condition event 2. At this time, the number $N_2$ of vehicles having passed through the exceptional road-condition event 2 is 2, which is equal to $\theta_N$, and accordingly, the confidence of the exceptional road-condition event 2 is calculated:

$$c_2=1/2=0.5$$

As shown in FIG. 7D, as $c_2$ is still smaller than the first order confidence threshold $\theta_1$ (55%), the exceptional road-condition event 2 is not added to the traffic information database.

Figure 7E:
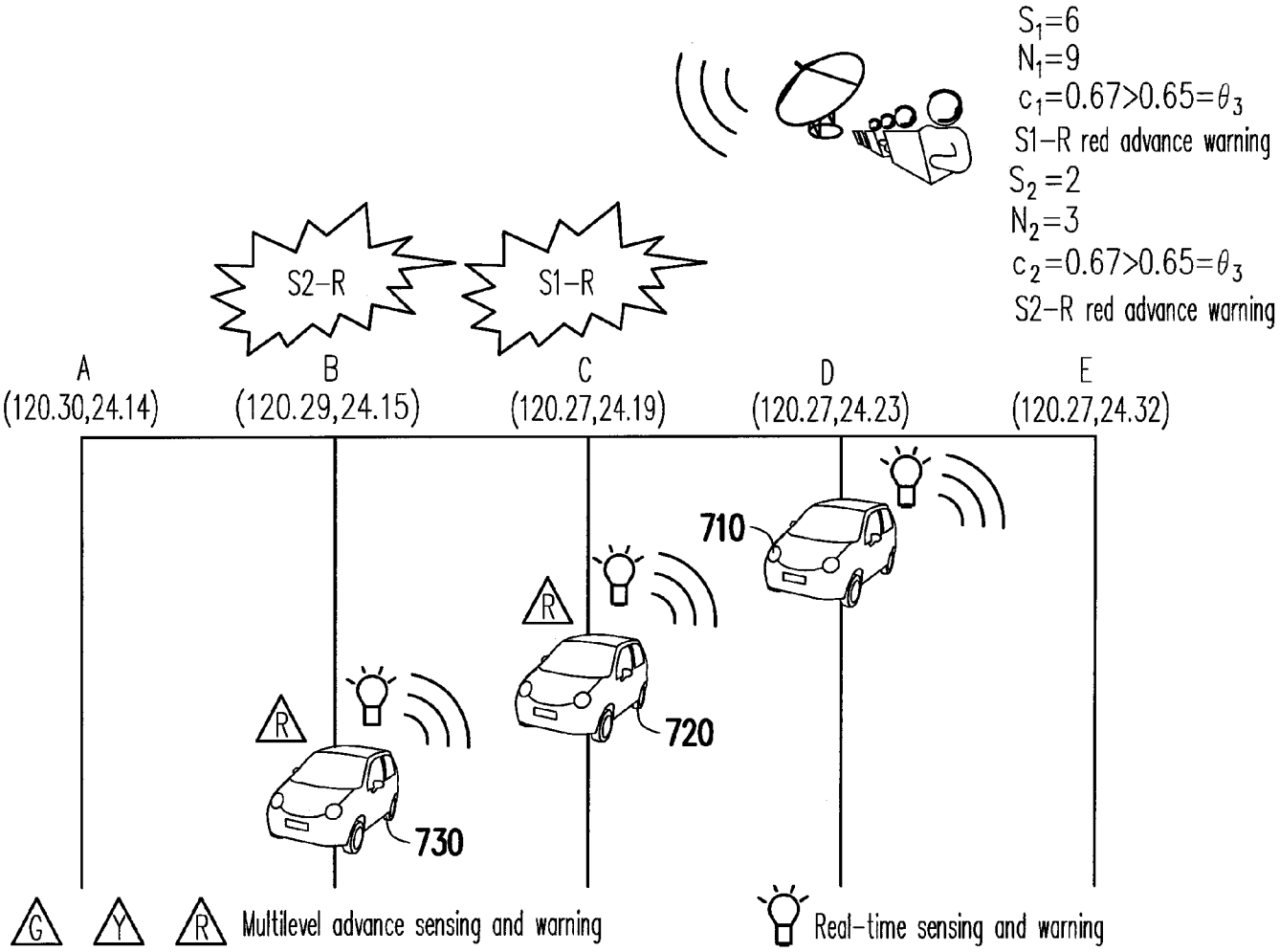

Referring to FIG. 7E, before the vehicle 720 arrives at the location C (120.27, 24.19), as the exceptional road-condition event 1 has been upgraded to a Y (yellow) warning, the system warns the driver and passenger in advance to notice that the exceptional road-condition event 1 is a Y (yellow) warning. At this time, the vehicle 720 and the vehicle 730 respectively detect the exceptional road-condition event 1 and the exceptional road-condition event 2, and thus update the confidences $c_1$ and $c_2$ at the same time. At this time, $c_2$=0.67(2/3), which is larger than the third order confidence threshold $\theta_3$ (65%), and therefore, the exceptional road-condition event 2 is added to the traffic information database. As the confidence $c_1$ also changes to 0.67 (2/3), which is larger than the third order confidence threshold $\theta_3$ (65%), both the exceptional road-condition event 1 and the exceptional road-condition event 2 are listed as red warnings of the third order confidence threshold, marked as "S1-R" and "S2-R" as shown in the figure.

FIG. 8A to FIG. 8E illustrate deletion of an invalid event from a traffic information database according to one of a plurality of embodiments of the disclosure.

It is assumed that the traffic information database records that a location B (120.29, 24.15) has an exceptional road-condition event 1 ("Warning site 1" in the figure), the number $N_1$ of vehicles having passed through the exceptional road-condition event 1 is 11, the intensity $s_1$ is 4, there is only one order of confidence threshold being $\theta_c$=30%, the basic time T' of the event 1 is 90 minutes, the event duration $\delta_1$ is 2 minutes, the initial value of the basic time validity conversion coefficient $\alpha_1$ is 1, and the initial value of the duration validity conversion coefficient $\beta_1$ is 1.

Figure 8A:
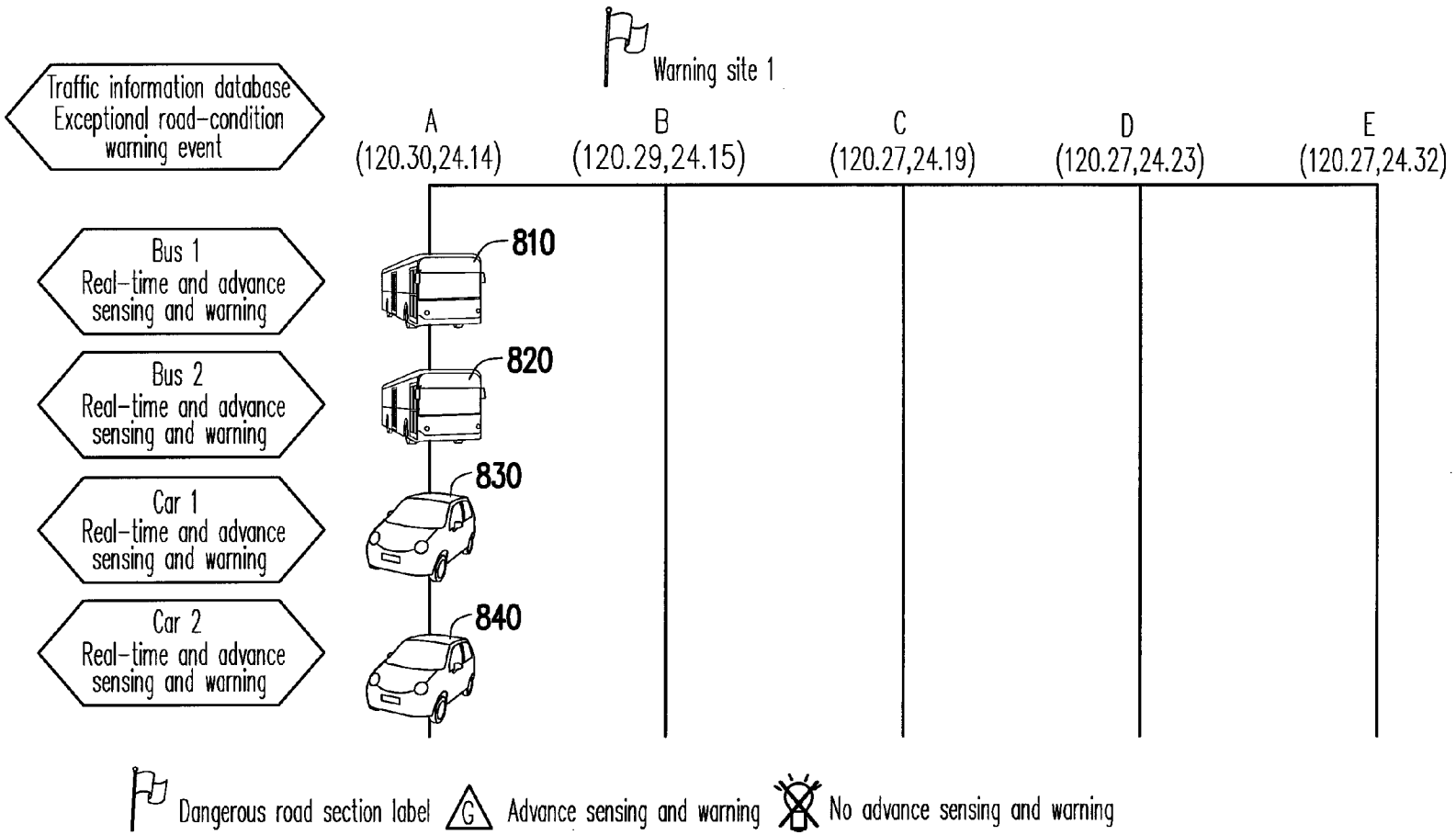
FIG. 8A to FIG. 8E illustrate deletion of an invalid event from a traffic information database according to one of a plurality of embodiments of the disclosure.

Referring to FIG. 8A, the confidence of the exceptional road-condition event 1 is calculated:

$$c_1=4/11=0.36$$

As $c_1\geq\theta_c$, the event is stored in the traffic information database, and vehicles approaching the location receive an advance warning.

Figure 8B:
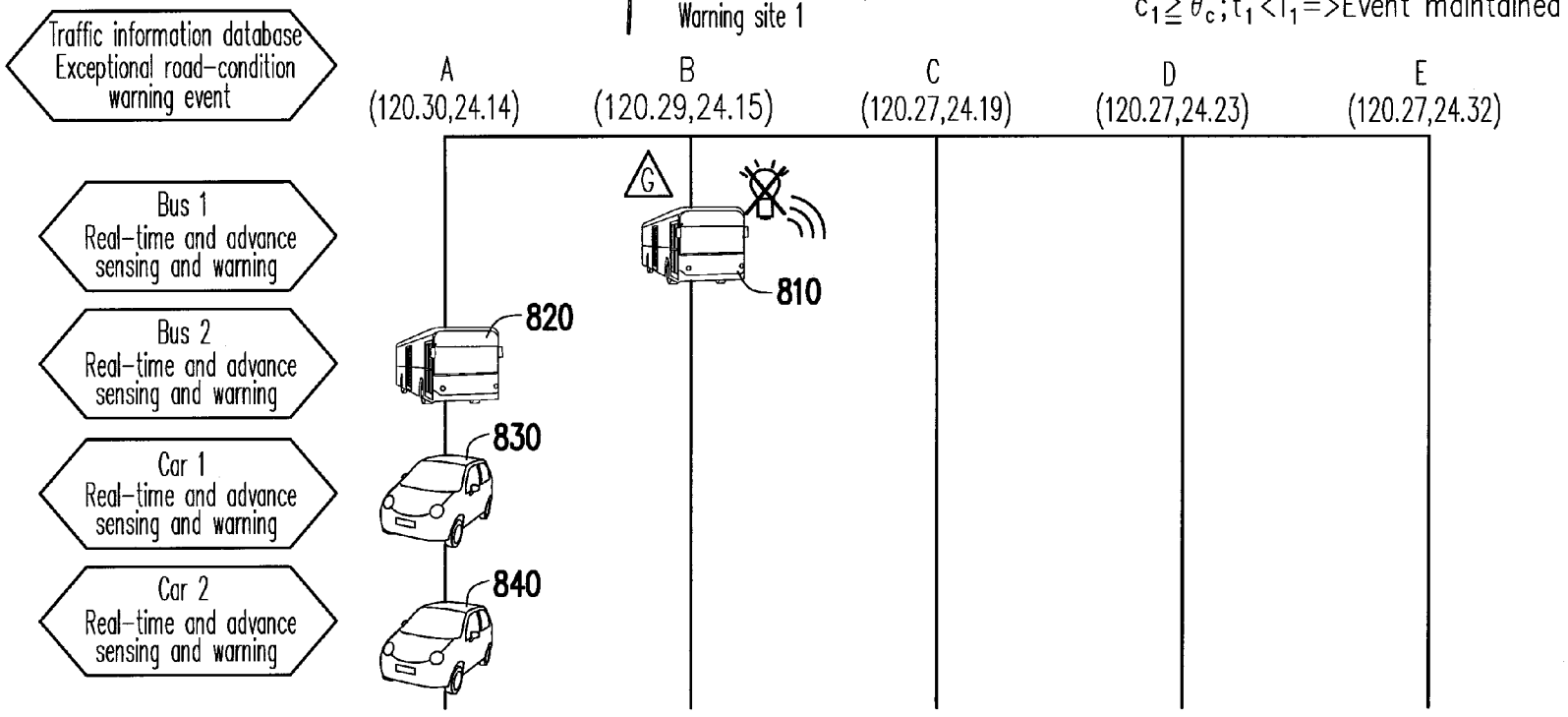

Referring to FIG. 8B, before a vehicle 810 passes by a location B (120.29, 24.15), the vehicle 810 receives advance warning information. In addition, the vehicle 810 does not detect real-time sensing and warning information.

Figure 8C:
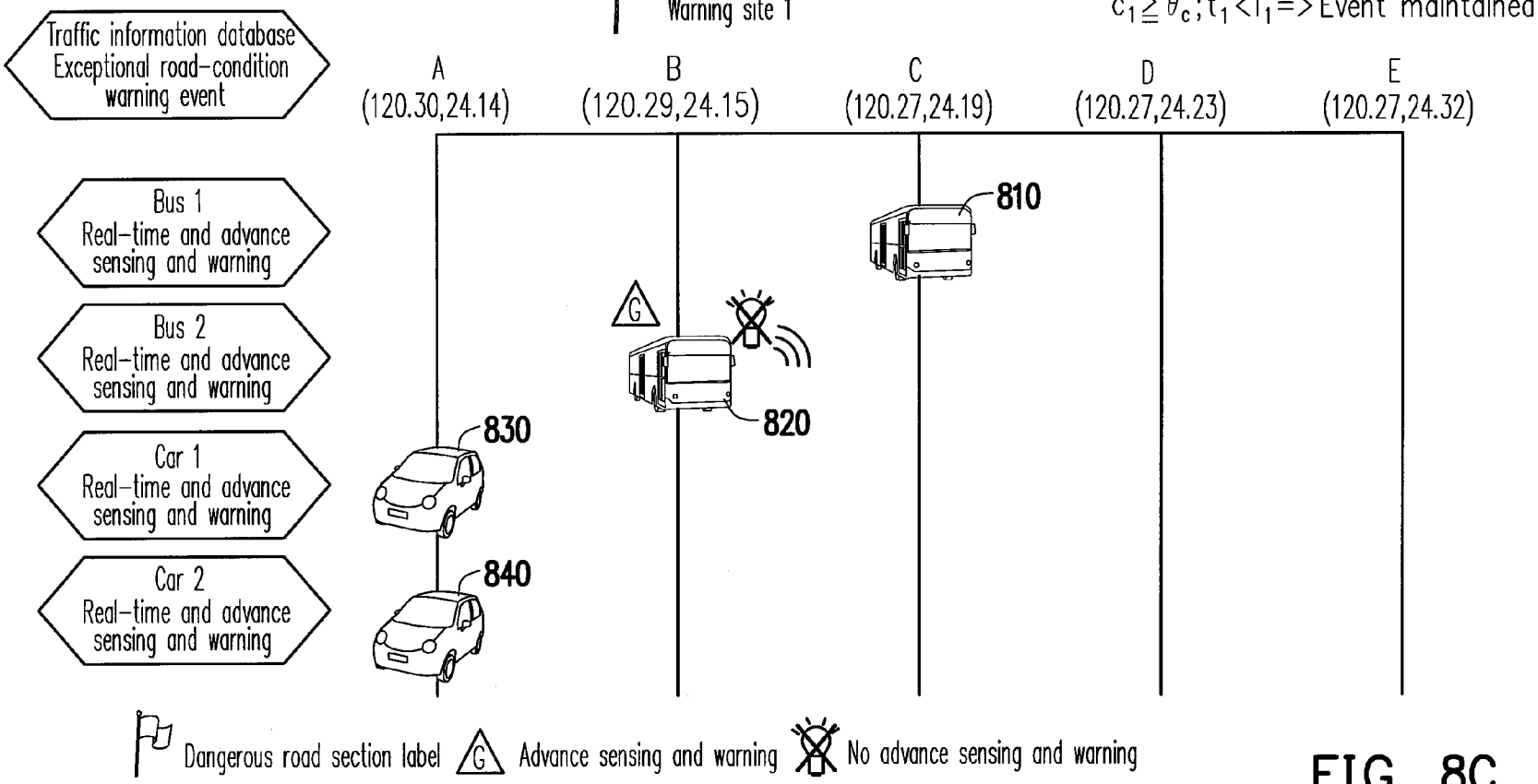

Referring to the top part of FIG. 8C, as the vehicle 810 does not detect real-time sensing and warning information, at this time, $\alpha_1$=1, $\beta_1$=1, $s_1$=4, $N_1$=12, and time since last time when the exceptional road-condition event 1 is detected is 20 minutes. The confidence $c_1$ of the exceptional road-condition event is updated, and it is judged whether the confidence $c_1$ of the exceptional road-condition event is smaller than a confidence threshold, or whether a detected valid time is larger than a valid time threshold $T_i$ ($T_i=T_i'\times\alpha_i+\delta_i\times\beta_i$), that is, the valid time threshold $T_i$ of the exceptional road condition i is the basic time $T_i'$ of the exceptional road-condition event i multiplied by the basic time validity conversion coefficient $\alpha_i$ plus the duration $\delta_i$ of the exceptional road-condition event i multiplied by the duration validity conversion coefficient $\beta_i$.

$$c_1=4/12=0.33$$

$$T_1=T_i'\times\alpha_i+\delta_i\times\beta_i=90\times1+2\times1=92$$

As the confidence $c_1$ of the exceptional road-condition event is larger than the confidence threshold, and the detected time (20 minutes) is smaller than $T_1$ (92), the condition for deleting the exceptional road-condition event 1 is not satisfied, and therefore, the exceptional road-condition event 1 is still maintained.

As shown in FIG. 8C, before a second vehicle 820 passes by the location B (120.29, 24.15), the vehicle 820 receives advance warning information. In addition, the vehicle 820 also does not detect real-time sensing and warning information.

Figure 8D:
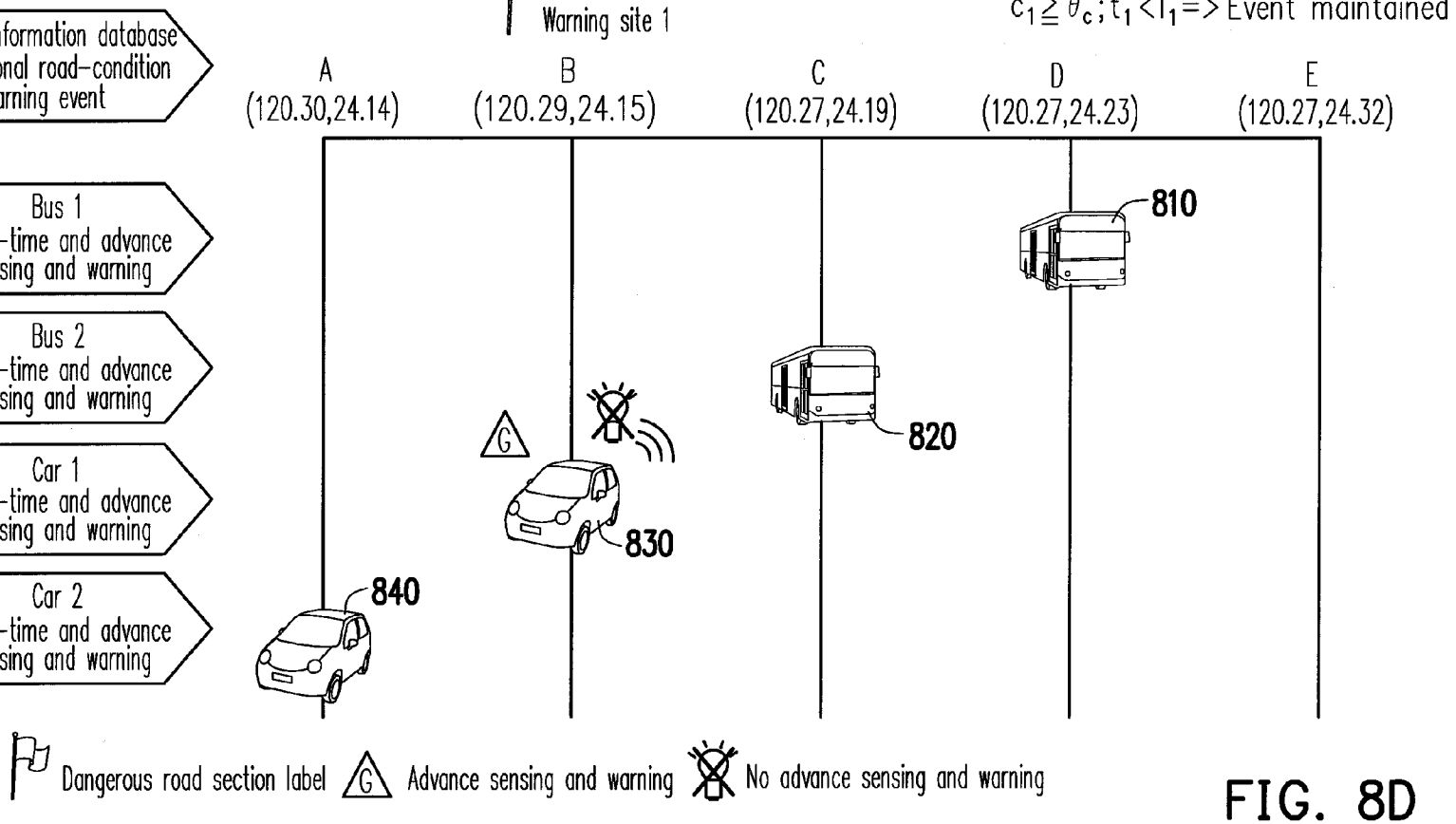

Referring to the top part of FIG. 8D, as the vehicle 820 does not detect real-time sensing and warning information, at this time, $\alpha_1$=0.9, $\beta_1$=0.8, $s_1$=4, $N_1$=13, and time since last time when the exceptional road-condition event 1 is detected is 35 minutes. The confidence $c_1$ of the exceptional road-condition event is updated, and it is judged whether the confidence $c_1$ of the exceptional road-condition event is smaller than the confidence threshold, or whether a detected valid time is larger than the threshold $T_i$ of the valid time i. Here, the coefficient $\alpha_i$ decreases as the intensity $s_i$ decreases; and the coefficient $\beta_i$ decreases as the time $t_i$ decreases.

$$c_1=4/13=0.31$$

$$T_1=T_i'\times\alpha_i+\delta_i\times\beta_i=90\times0.9+2\times0.8=82.6$$

As the confidence $c_1$ of the exceptional road-condition event is larger than the confidence threshold, and the detected time (35 minutes) is smaller than $T_1$ (82.6), the condition for deleting the exceptional road-condition event 1 is not satisfied, and therefore, the exceptional road-condition event 1 is maintained.

As shown in FIG. 8D, when a third vehicle 830 passes by the location B (120.29, 24.15), the third vehicle 830 receives advance warning information.

Figure 8E:
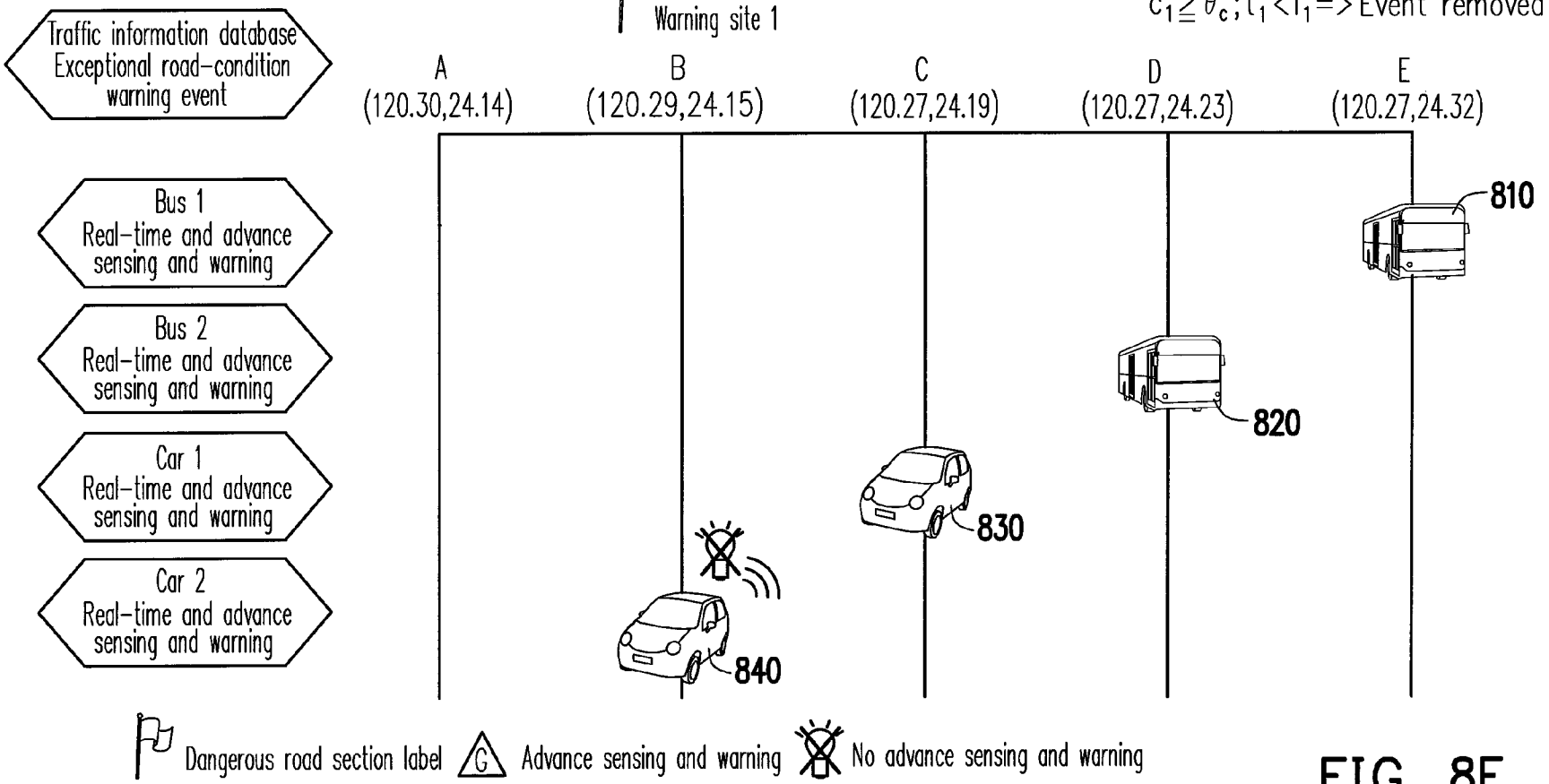

Referring to the top part of FIG. 8E, as the third vehicle 830 does not detect real-time sensing and warning information when passing by the location B, at this time, $\alpha_1$=0.8, $\beta_1$=0.7, $s_1$=4, $N_1$=14, and time since last time when the event 1 is detected is 45 minutes. The confidence $c_1$ of the exceptional road-condition event is updated, and it is judged whether the confidence $c_1$ of the exceptional road-condition event is smaller than the confidence threshold, or whether a detected valid time is larger than the threshold $T_i$ of the valid time i.

$$c_1=4/14=0.29$$

$$T_1=T_i'\times\alpha_i+\delta_i\times\beta_i=90\times0.8+2\times0.7=73.4$$

As the confidence $c_1$ of the exceptional road-condition event is smaller than the confidence threshold $\theta_c$ (30%), the exceptional road-condition event 1 is deleted.

As shown in FIG. 8E, as the exceptional road-condition event 1 has been deleted from the traffic information database, no advance warning information is displayed when a vehicle 840 passes by the location.

It will be apparent to those skilled in the art that various modifications and variations can be made to the structure of the disclosed embodiments without departing from the scope or spirit of the disclosure. In view of the foregoing, it is intended that the disclosure cover modifications and variations of this disclosure provided they fall within the scope of the following claims and their equivalents.

What is claimed is:

1. A warning system for a vehicle, the warning system comprising a back-end system and at least one exceptional road-condition warning device for a vehicle, wherein the back-end system comprises a storage device, storing a traffic information database, wherein the traffic information database is used for storing exceptional road-condition warning event information; and a cooperative self-learning unit, receiving one or more exceptional road-condition events transmitted from the at least one exceptional road-condition warning device, and determining whether to modify the exceptional road-condition warning event information and further update the content of the traffic information database; and each of the at least one exceptional road-condition warning device comprises an advance sensing and warning unit, obtaining vehicle positioning information and obtaining the exceptional road-condition warning event information from the traffic information database, and comparing a plurality of warning locations corresponding to the exceptional road-condition warning event information with the vehicle positioning information, so as to judge whether to generate a warning signal corresponding to the exceptional road-condition warning event information, wherein the determining whether to modify the exceptional road-condition warning event information comprises:

judging whether a portion of the exceptional road-condition warning event information corresponding to the received exceptional road-condition events exists, and if not, calculating a confidence count corresponding to the exceptional road-condition events;

if another one of the exceptional road-condition events which is the same as the exceptional road-condition events is received again, further adjusting the confidence count corresponding to the exceptional road-condition events; and judging whether the confidence count is higher than a confidence threshold, and if yes, adding the portion of the exceptional road-condition warning event information corresponding to the exceptional road-condition events.

2. The warning system according to claim 1, wherein the exceptional road-condition warning device further comprises:

a real-time sensing and warning unit, obtaining vehicle dynamic data, and analyzing the vehicle dynamic data in real time to judge whether a current driving state and a driving environment match a definition of the exceptional road-condition events, and if yes, transmitting the exceptional road-condition events to the back-end system.

3. The warning system according to claim 2, wherein conditions for judging whether the current driving state and the driving environment match the definition of the exceptional road-condition events comprise road surface bumps, frequent braking, abrupt turning, or occurrence of an environment different from normal vehicle driving environment.

4. The warning system according to claim 2, wherein the real-time sensing and warning unit comprises:

a vehicle dynamics analyzing unit, receiving sensing data, and accordingly obtaining the vehicle dynamic data by analyzing the sensing data; and an exceptional road-condition recognizing unit, recognizing whether the vehicle dynamic data is the exceptional road-condition events in real time.

5. The warning system according to claim 4, further comprising a sensor, dynamically sensing the vehicle in real time, so as to obtain the current driving state and the driving environment of the vehicle.

6. The warning system according to claim 5, wherein the sensor comprises a gyro or an accelerometer.

7. The warning system according to claim 5, wherein a result of dynamically sensing the driving state of the vehicle in real time comprises triaxial acceleration, angular velocity, steering angle, engine speed, vehicle speed, or a combination thereof.

8. The warning system for a vehicle according to claim 1, wherein the back-end system further comprises:

a real-time event receiving module, receiving and transmitting the exceptional road-condition events to the cooperative self-learning unit.

9. The warning system according to claim 8, wherein the real-time event receiving module obtains the exceptional road-condition events through wireless communication with the exceptional road-condition warning device of the vehicle.

10. The warning system according to claim 1, wherein the exceptional road-condition warning device further comprises a display device, receiving the warning signal, and accordingly displaying the warning signal.

11. The warning system according to claim 1, wherein the advance sensing and warning unit comprises a storage device, storing a warning location database, wherein the warning location database comprises the exceptional road-condition event information; and a warning location comparing unit, obtaining the exceptional road-condition event information and the vehicle positioning information from the warning location database, and comparing the plurality of warning locations corresponding to the exceptional road-condition event information with the vehicle positioning information, so as to judge whether to generate the warning signal.

12. The warning system according to claim 11, further comprising a vehicle positioning information generating device, obtaining the vehicle positioning information for the vehicle.

13. The warning system according to claim 12, wherein the vehicle positioning information generating device is a Global Positioning System (GPS).

14. The warning system according to claim 11, wherein the back-end system further comprises a database real-time update unit, capable of accessing the traffic information database, and the exceptional road-condition warning device further comprises a database update interface, wirelessly connected to the database real-time update unit, updating the exceptional road-condition event information stored in the warning location database in synchronization with the traffic information database through the database real-time update unit.

15. A warning method for a vehicle, comprising:

receiving one or more exceptional road-condition events, so as to determine whether to add exceptional road-condition warning event information stored in a traffic information database;

transmitting the exceptional road-condition warning event information; and obtaining vehicle positioning information and obtaining the exceptional road-condition warning event information from the traffic information database, and comparing a plurality of warning locations corresponding to the exceptional road-condition warning event information with the vehicle positioning information, so as to judge whether to generate a warning signal corresponding to the exceptional road-condition events, wherein the step of determining whether to add the exceptional road-condition warning event information comprises:

judging whether a portion of the exceptional road-condition warning event information corresponding to the received exceptional road-condition events exists, and if not, calculating a confidence count corresponding to the exceptional road-condition events;

if another one of the exceptional road-condition events which is the same as the exceptional road-condition events is received again, further adjusting the confidence count corresponding to the exceptional road-condition events; and judging whether the confidence count is higher than a confidence threshold, and if yes, adding the portion of the exceptional road-condition warning event information corresponding to the exceptional road-condition events.

16. The warning method according to claim 15, further comprising:

performing a real-time sensing procedure to obtain vehicle dynamic data; and recognizing whether the vehicle dynamic data is the exceptional road-condition events, and if yes, transmitting the exceptional road-condition events.

17. The warning method according to claim 16, wherein the real-time sensing procedure comprises:

receiving sensing data, and obtaining the vehicle dynamic data by analyzing the sensing data; and recognizing the vehicle dynamic data, and analyzing the vehicle dynamic data in real time to judge whether a current driving state and a driving environment match a definition of the exceptional road-condition events, and if yes, transmitting the exceptional road-condition events.

18. The warning method according to claim 17, wherein conditions for judging whether the current driving state and driving environment match the definition of the exceptional road-condition events comprise road surface bumps, frequent braking, abrupt turning, or occurrence of an environment different from normal vehicle driving dynamics.

19. The warning method according to claim 17, further comprising a sensor dynamically sensing the vehicle in real time, so as to obtain the current driving state and the driving environment of the vehicle.

20. The warning method according to claim 19, wherein the sensor comprises a gyro or an accelerometer.

21. The warning method according to claim 19, wherein a result of dynamically sensing the driving state of the vehicle in real time by the sensor comprises triaxial acceleration, angular velocity, steering angle, engine speed, vehicle speed, or a combination thereof.

22. The warning method according to claim 15, wherein the exceptional road-condition warning event information are classified into a plurality of types, each of the types has a corresponding confidence threshold, and the warning signal have different corresponding information according to different types of the exceptional road-condition warning event information.

23. The warning method according to claim 15, wherein the exceptional road-condition warning event information is obtained from the exceptional road-condition events transmitted by a plurality of vehicles that have previously passed by a location corresponding to the vehicle positioning information in the same driving direction.

24. A warning system for a vehicle, the warning system comprising a back-end system and at least one exceptional road-condition warning device for a vehicle, wherein the back-end system comprises a storage device, storing a traffic information database, wherein the traffic information database is used for storing exceptional road-condition warning event information; and a cooperative self-learning unit, receiving one or more exceptional road-condition events transmitted from the exceptional road-condition warning devices, and determining whether to modify the exceptional road-condition warning event information and further update the content of the traffic information database; and each of the exceptional road-condition warning devices comprises an advance sensing and warning unit, obtaining vehicle positioning information and obtaining the exceptional road-condition warning event information from the traffic information database, and comparing a plurality of warning locations corresponding to the exceptional road-condition warning event information with the vehicle positioning information, so as to judge whether to generate a warning signal corresponding to the exceptional road-condition warning event information, wherein the determining whether to modify the exceptional road-condition warning event information comprises:

for each of the received exceptional road-condition events, adjusting a confidence count corresponding to the exceptional road-condition events; and judging whether the confidence count is lower than a confidence threshold, and if yes, deleting a portion of the exceptional road-condition warning event information corresponding to the exceptional road-condition events.

25. The warning system according to claim 24, wherein the determining whether to modify the exceptional road-condition warning event information further comprises:

if the confidence count is higher than the confidence threshold, further obtaining a warning event valid time corresponding to the exceptional road-condition events based on time at which the exceptional road-condition events is received; and comparing the warning event valid time with a valid time threshold, and if the warning event valid time is larger than the valid time threshold, deleting the portion of the exceptional road-condition warning event information corresponding to the exceptional road-condition events.

26. A warning method for a vehicle, comprising:

receiving one or more exceptional road-condition events, so as to determine whether to delete exceptional road-condition warning event information stored in a traffic information database;

transmitting the exceptional road-condition warning event information; and obtaining vehicle positioning information and obtaining the exceptional road-condition warning event information from the traffic information database, and comparing a plurality of warning locations corresponding to the exceptional road-condition warning event information with the vehicle positioning information, so as to judge whether to generate a warning signal corresponding to the exceptional road-condition events, wherein the determining whether to delete the exceptional road-condition warning event information comprises:

for each of the received exceptional road-condition events, adjusting a confidence count corresponding to the exceptional road-condition events; and judging whether the confidence count is lower than a confidence threshold, and if yes, deleting a portion of the exceptional road-condition warning event information corresponding to the exceptional road-condition events.

27. The warning method according to claim 26, wherein the step of determining whether to delete the exceptional road-condition warning event information further comprises:

if the confidence count is higher than the confidence threshold, further obtaining a warning event valid time corresponding to the exceptional road-condition events based on time at which the exceptional road-condition events is received; and comparing the warning event valid time with a valid time threshold, and if the warning event valid time is larger than the valid time threshold, deleting a portion of the exceptional road-condition warning event information corresponding to the exceptional road-condition events.

* * * * *